US010429765B1

(12) United States Patent
Leemhuis

(10) Patent No.: US 10,429,765 B1
(45) Date of Patent: Oct. 1, 2019

(54) TONER CONTAINER FOR AN IMAGE FORMING DEVICE HAVING MAGNETS OF VARYING ANGULAR OFFSET FOR TONER LEVEL SENSING

(71) Applicant: LEXMARK INTERNATIONAL, INC., Lexington, KY (US)

(72) Inventor: Michael Craig Leemhuis, Nicholasville, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/027,643

(22) Filed: Jul. 5, 2018

(51) Int. Cl.
*G03G 15/08* (2006.01)

(52) U.S. Cl.
CPC ..... *G03G 15/0858* (2013.01); *G03G 15/087* (2013.01); *G03G 2215/0888* (2013.01)

(58) Field of Classification Search
CPC ..... G03G 15/086; G03G 15/0856; G03G 15/0858; G03G 15/087; G03G 15/0889; G03G 2215/0888
USPC ..... 399/61, 263
See application file for complete search history.

(56) References Cited

U.S. PATENT DOCUMENTS 3,920,155 A 11/1975 Whited
3,979,022 A * 9/1976 Whited ..... G01F 23/0007 222/23
4,506,804 A 3/1985 Oka
4,592,642 A 6/1986 Imaizumi et al.
4,989,754 A 2/1991 Grasso et al.
5,111,247 A 5/1992 Nichols
5,216,462 A 6/1993 Nakajima et al.
5,237,372 A 8/1993 Ishii et al.
5,383,007 A 1/1995 Kinoshita et al.
5,436,704 A * 7/1995 Moon ..... G03G 15/0822 399/256
5,587,770 A 12/1996 Jo et al.
(Continued)

FOREIGN PATENT DOCUMENTS

CN 2454308 Y 10/2001
JP S55-143410 A 11/1980
(Continued)

OTHER PUBLICATIONS

JPO Machine translation of JP 3351179B2.
(Continued)

*Primary Examiner* — Robert B Beatty

(57) ABSTRACT

A toner container according to one example embodiment includes a housing having a reservoir for storing toner. A rotatable shaft is positioned within the reservoir and has an axis of rotation. A first magnet is rotatable with the shaft around the axis of rotation. An arm connected to the shaft leads the first magnet around the axis of rotation in an operative rotational direction of the shaft. A second magnet connected to the shaft trails the first magnet around the axis of rotation in the operative rotational direction. The arm is operatively connected to the second magnet such that an angular offset between the first magnet and the second magnet increases as an angular offset between the first magnet and the arm increases and the angular offset between the first magnet and the second magnet decreases as the angular offset between the first magnet and the arm decreases.

20 Claims, 13 Drawing Sheets

(56) References Cited

U.S. PATENT DOCUMENTS

| | | | | |
|---|---|---|---|---|
| 5,634,169 | A | 5/1997 | Barry et al. | |
| 5,995,772 | A | 11/1999 | Barry et al. | |
| 6,032,004 | A | 2/2000 | Mirabella, Jr. et al. | |
| 6,100,601 | A | 8/2000 | Baker et al. | |
| 6,246,841 | B1 | 6/2001 | Merrifield et al. | |
| 6,336,015 | B1 | 1/2002 | Numagami | |
| 6,343,883 | B1 | 2/2002 | Tada et al. | |
| 6,397,018 | B1 | 5/2002 | Matsumoto et al. | |
| 6,459,876 | B1 | 10/2002 | Buchanan et al. | |
| 6,496,662 | B1 | 12/2002 | Buchanan et al. | |
| 6,510,291 | B2 | 1/2003 | Campbell et al. | |
| 6,546,213 | B2 | 4/2003 | Ito et al. | |
| 6,580,881 | B2 | 6/2003 | Coriale et al. | |
| 6,600,882 | B1 | 7/2003 | Applegate et al. | |
| 6,654,569 | B2 | 11/2003 | Nozawa | |
| 6,718,147 | B1 | 4/2004 | Carter et al. | |
| 6,819,884 | B1 | 11/2004 | Carter et al. | |
| 6,972,558 | B1 | 12/2005 | Robinson | |
| 7,103,308 | B2 | 9/2006 | Wakana | |
| 7,139,505 | B2 | 11/2006 | Askren et al. | |
| 7,177,567 | B2 | 2/2007 | Miller | |
| 7,187,876 | B2 | 3/2007 | Ito et al. | |
| 7,231,153 | B2 | 6/2007 | May | |
| 7,248,806 | B2 | 7/2007 | Askren et al. | |
| 7,399,074 | B2 | 7/2008 | Aldrich et al. | |
| 7,551,862 | B2 | 6/2009 | Tanaka et al. | |
| 7,555,231 | B2 | 6/2009 | Etter et al. | |
| 7,782,198 | B2 | 8/2010 | Crockett et al. | |
| 8,208,836 | B2 | 6/2012 | Shimomura | |
| 8,401,440 | B2 | 3/2013 | Oba et al. | |
| 8,417,157 | B2 | 4/2013 | Saito et al. | |
| 8,594,526 | B2 | 11/2013 | Mushika et al. | |
| 8,718,496 | B2 | 5/2014 | Barry et al. | |
| 9,280,084 | B1 * | 3/2016 | Carpenter | G03G 15/087 |
| 9,291,989 | B1 * | 3/2016 | Carpenter | G03G 21/1642 |
| 9,335,656 | B2 | 5/2016 | Carpenter et al. | |
| 9,389,582 | B2 | 7/2016 | Carpenter et al. | |
| 9,519,243 | B2 | 12/2016 | Carpenter et al. | |
| 9,841,722 | B2 * | 12/2017 | Carpenter | G03G 15/086 |
| 9,983,506 | B2 * | 5/2018 | Carpenter | G03G 15/086 |
| 2001/0051051 | A1 | 12/2001 | Matsumoto | |
| 2002/0091413 | A1 | 7/2002 | Cappa et al. | |
| 2002/0168192 | A1 | 11/2002 | Surya et al. | |
| 2006/0000279 | A1 | 1/2006 | Jamnia et al. | |
| 2006/0198643 | A1 | 9/2006 | Kimura et al. | |
| 2006/0291910 | A1 | 12/2006 | Choi et al. | |
| 2007/0196137 | A1 | 8/2007 | Hebner et al. | |
| 2008/0226351 | A1 | 9/2008 | Dawson et al. | |
| 2009/0185833 | A1 | 7/2009 | Shimomura | |
| 2009/0190938 | A1 | 7/2009 | Teramura | |
| 2010/0202798 | A1 | 8/2010 | Suzuki et al. | |
| 2010/0303484 | A1 | 12/2010 | Hogan et al. | |
| 2011/0206389 | A1 * | 8/2011 | Naruse | G03G 15/0877 399/27 |
| 2011/0206391 | A1 | 8/2011 | Naruse | |
| 2011/0311270 | A1 | 12/2011 | Takagi et al. | |
| 2012/0045224 | A1 | 2/2012 | Amann et al. | |
| 2012/0070162 | A1 | 3/2012 | Barry | |
| 2012/0099900 | A1 | 4/2012 | Noguchi et al. | |
| 2012/0170948 | A1 | 7/2012 | Kwon et al. | |
| 2013/0004208 | A1 | 1/2013 | Shimomura | |
| 2013/0039670 | A1 | 2/2013 | Hosoya et al. | |
| 2013/0202275 | A1 | 8/2013 | Brown et al. | |
| 2013/0257455 | A1 | 10/2013 | Ahne et al. | |
| 2013/0343777 | A1 | 12/2013 | Amann et al. | |
| 2014/0029960 | A1 | 1/2014 | Ahne et al. | |
| 2014/0037305 | A1 | 2/2014 | Monde et al. | |
| 2014/0079438 | A1 | 3/2014 | Abler et al. | |
| 2014/0105619 | A1 | 4/2014 | Elliott et al. | |
| 2014/0105620 | A1 | 4/2014 | Elliott et al. | |
| 2014/0105622 | A1 | 4/2014 | True et al. | |
| 2014/0169806 | A1 | 6/2014 | Leemhuis et al. | |
| 2014/0169807 | A1 | 6/2014 | Leemhuis et al. | |
| 2014/0169808 | A1 | 6/2014 | Leemhuis et al. | |
| 2014/0169810 | A1 | 6/2014 | Leemhuis et al. | |
| 2014/0205305 | A1 | 7/2014 | Leemhuis et al. | |
| 2014/0212155 | A1 | 7/2014 | Leemhuis et al. | |
| 2014/0226994 | A1 | 8/2014 | Leemhuis et al. | |
| 2016/0216641 | A1 | 7/2016 | Makie et al. | |
| 2018/0059613 | A1 | 3/2018 | Carpenter et al. | |

FOREIGN PATENT DOCUMENTS

| | | | | |
|---|---|---|---|---|
| JP | S60-107664 | A | 6/1985 | |
| JP | 60230166 | A * | 11/1985 | G03G 15/0856 |
| JP | H04-358179 | A | 12/1992 | |
| JP | H05-046026 | A | 2/1993 | |
| JP | 2000-155461 | A | 6/2000 | |
| JP | 2002-108086 | A | 4/2002 | |
| JP | 2002-132036 | A | 5/2002 | |
| JP | 3351179 | B2 | 11/2002 | |
| JP | 2005208121 | A * | 8/2005 | |
| JP | 2007-192852 | A | 8/2007 | |
| JP | 2010175768 | A * | 8/2010 | |
| WO | 2012144324 | A1 | 10/2012 | |

OTHER PUBLICATIONS

JPO Machine translation of JP 2002-108086A.
JPO Machine translation of JP 2000-155461A.
JPO Machine translation of JP S60-107664A.
JPO Machine translation of JP 2007-192852A.
JPO Machine translation of JP S55-143410A.
JPO Machine translation of JP H04-358179A.
JPO Machine translation of JP H05-046026A.
JPO Machine translation of JP 2002-132036A.
U.S. Appl. No. 16/027,657, filed Jul. 5, 2018 (Leemhuis et al.).
U.S. Appl. No. 16/041,048, filed Jul. 20, 2018 (Leemhuis).
U.S. Appl. No. 16/041,075, filed Jul. 20, 2018 (Leemhuis et al.).
U.S. Appl. No. 16/041,089, filed Jul. 20, 2018 (Leemhuis et al.).
U.S. Appl. No. 16/041,109, filed Jul. 20, 2018 (Leemhuis et al.).
EPO machine translation of CN 2454308 Y (Pason).

* cited by examiner

TONER CONTAINER FOR AN IMAGE FORMING DEVICE HAVING MAGNETS OF VARYING ANGULAR OFFSET FOR TONER LEVEL SENSING

CROSS REFERENCES TO RELATED APPLICATIONS

None.

BACKGROUND

1. Field of the Disclosure

The present disclosure relates generally to image forming devices and more particularly to a toner container for an image forming device having magnets of varying angular offset for toner level sensing.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units installed in the image forming device. As these replaceable units run out of toner, the units must be replaced or refilled in order to continue printing. As a result, it is desired to measure the amount of toner remaining in these units in order to warn the user that one of the replaceable units is near an empty state or to prevent printing after one of the units is empty in order to prevent damage to the image forming device. Accordingly, a system for measuring the amount of toner remaining in a replaceable unit of an image forming device is desired.

SUMMARY

A toner container according to one example embodiment includes a housing having a reservoir for storing toner. A rotatable shaft is positioned within the reservoir and has an axis of rotation. A first magnet is rotatable with the rotatable shaft around the axis of rotation. An arm is connected to the shaft and leads the first magnet around the axis of rotation in an operative rotational direction of the rotatable shaft. A second magnet is connected to the shaft and trails the first magnet around the axis of rotation in the operative rotational direction of the rotatable shaft. The arm and the second magnet are each rotatable independent of the rotatable shaft between a respective forward rotational stop and a respective rearward rotational stop such that an angular offset between the first magnet and the arm and an angular offset between the first magnet and the second magnet vary depending on a rotational position of the arm and a rotational position of the second magnet relative to the respective forward rotational stop and the respective rearward rotational stop. The arm is operatively connected to the second magnet such that an amount of the angular offset between the first magnet and the second magnet increases as an amount of the angular offset between the first magnet and the arm increases and the amount of the angular offset between the first magnet and the second magnet decreases as the amount of the angular offset between the first magnet and the arm decreases.

A toner container according to another example embodiment includes a housing having a reservoir for storing toner. A rotatable shaft is positioned within the reservoir and has an axis of rotation. A first magnet is rotatable with the rotatable shaft around the axis of rotation. An arm is connected to the shaft and rotatable around the axis of rotation independent of the rotatable shaft within a predetermined angular range of motion relative to the rotatable shaft. The arm leads the first magnet in an operative rotational direction of the rotatable shaft. A second magnet is connected to the shaft and rotatable around the axis of rotation independent of the rotatable shaft within a predetermined angular range of motion relative to the rotatable shaft. The second magnet trails the first magnet in the operative rotational direction of the rotatable shaft. The arm and the second magnet are operatively connected such that an amount of angular offset between the first magnet and the second magnet increases as an amount of angular offset between the first magnet and the arm increases and the amount of angular offset between the first magnet and the second magnet decreases as the amount of angular offset between the first magnet and the arm decreases.

A toner container according to another example embodiment includes a housing having a reservoir for storing toner. A rotatable shaft is positioned within the reservoir and has an axis of rotation. A first magnet is connected to the shaft and fixed to rotate around the axis of rotation with the shaft. A paddle is connected to the shaft and leads the first magnet around the axis of rotation in an operative rotational direction of the rotatable shaft. The paddle is rotatable independent of the rotatable shaft between a first forward rotational stop and a first rearward rotational stop. A second magnet is connected to the shaft and trails the first magnet around the axis of rotation in the operative rotational direction of the shaft. The second magnet is rotatable independent of the rotatable shaft between a second forward rotational stop and a second rearward rotational stop. A linkage connects the paddle and the second magnet such that an amount of angular offset between the first magnet and the paddle increases as an amount of angular offset between the first magnet and the second magnet increases and the amount of angular offset between the first magnet and the paddle decreases as the amount of angular offset between the first magnet and the second magnet decreases. The first magnet and the second magnet pass near a point on an inner wall of the housing forming the reservoir once per revolution of the rotatable shaft for detection by a magnetic sensor when the toner container is installed in an image forming device for determining an amount of toner present in the reservoir based on the amount of angular offset between the first magnet and the second magnet.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
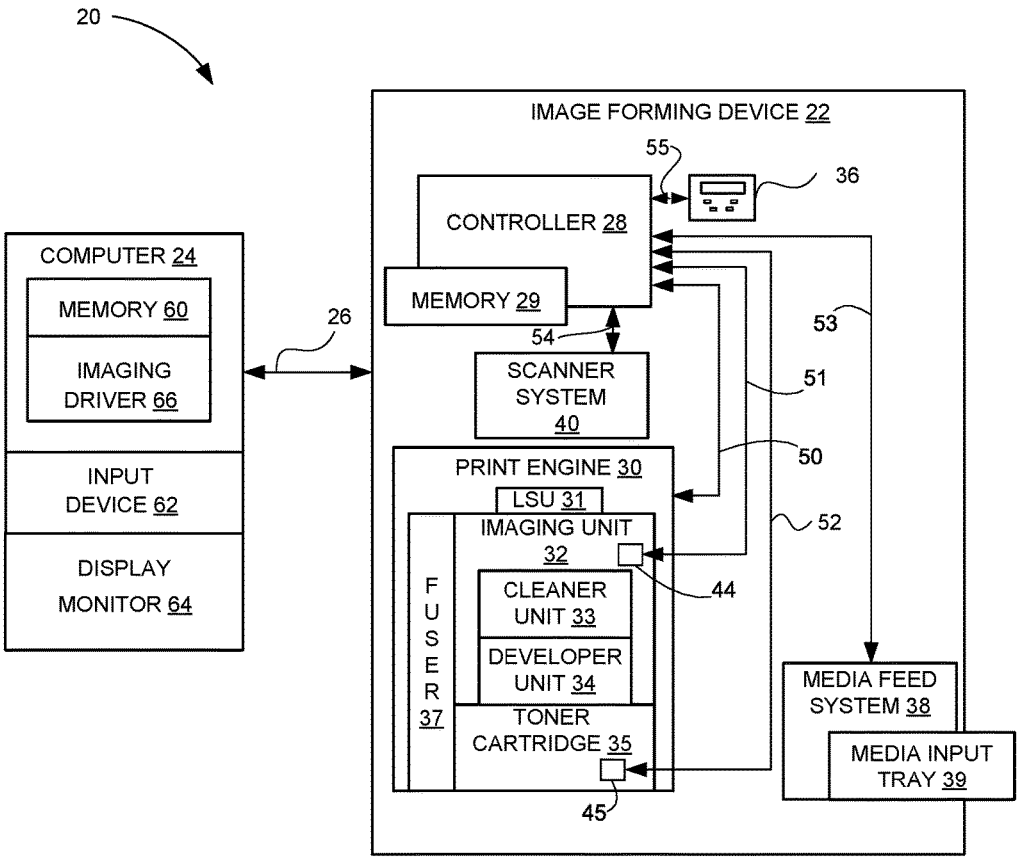
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29. The processor unit may include one or more integrated circuits in the form of a microprocessor or central processing unit and may be formed as one or more Application-Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 35, imaging unit 32, and a fuser 37, all mounted within image forming device 22. Imaging unit 32 is removably mounted in image forming device 22 and includes a developer unit 34 that houses a toner sump and a toner delivery system. In one embodiment, the toner delivery system utilizes what is commonly referred to as a single component development system. In this embodiment, the toner delivery system includes a toner adder roll that provides toner from the toner sump to a developer roll. A doctor blade provides a metered uniform layer of toner on the surface of the developer roll. In another embodiment, the toner delivery system utilizes what is commonly referred to as a dual component development system. In this embodiment, toner in the toner sump of developer unit 34 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 34 includes a magnetic roll that attracts the magnetic carrier beads having toner thereon to the magnetic roll through the use of magnetic fields.

Imaging unit 32 also includes a cleaner unit 33 that houses a photoconductive drum and a waste toner removal system. Toner cartridge 35 is removably mounted in imaging forming device 22 in a mating relationship with developer unit 34 of imaging unit 32. An outlet port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll (in the case of a single component development system) or by the magnetic roll (in the case of a dual component development system) to create a toned image. The toned image is then transferred to a media sheet received by imaging unit 32 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
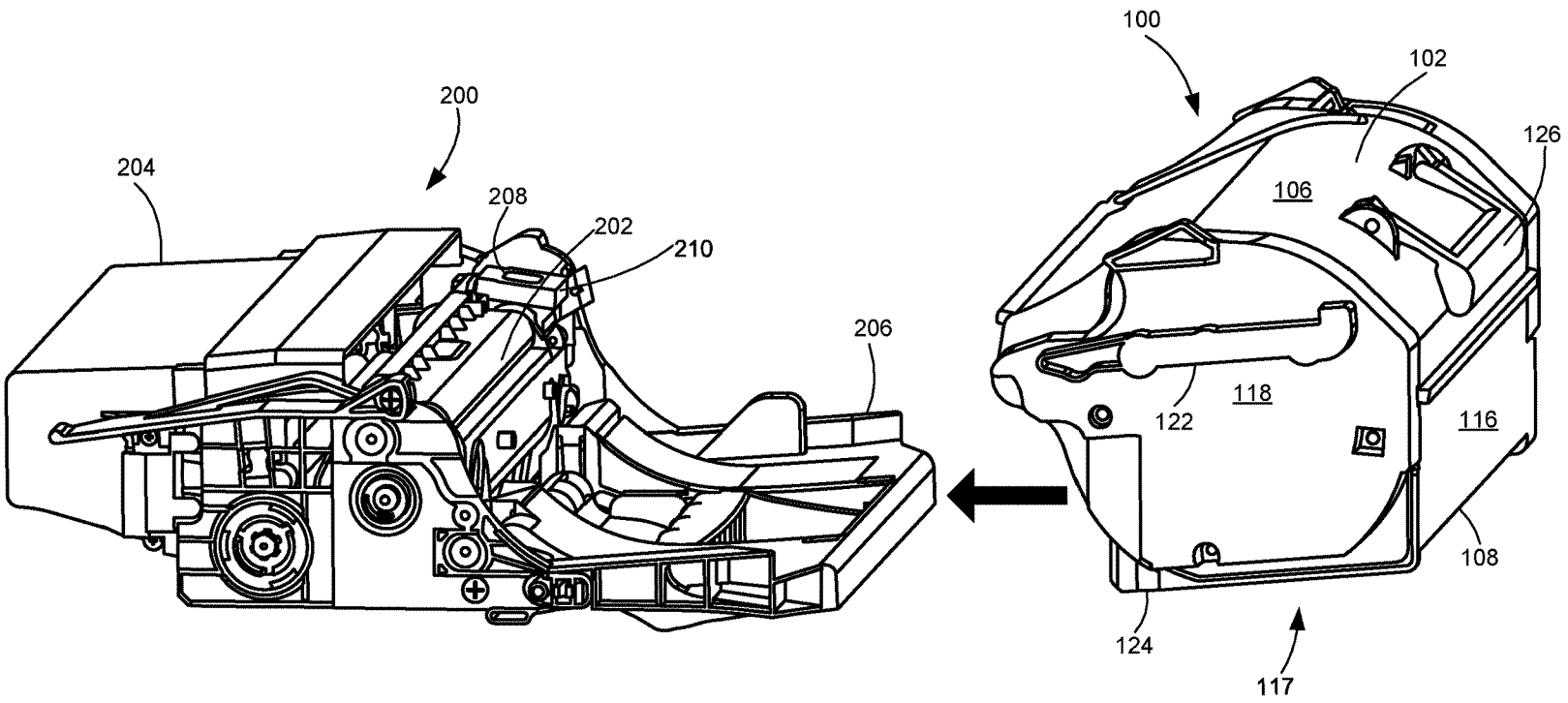
FIG. 2 is a perspective view of a toner cartridge and an imaging unit according to one example embodiment.

Referring now to FIG. 2, a toner cartridge 100 and an imaging unit 200 are shown according to one example embodiment. Imaging unit 200 includes a developer unit 202 and a cleaner unit 204 mounted on a common frame 206. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow shown in FIG. 2. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

Figure 3A:
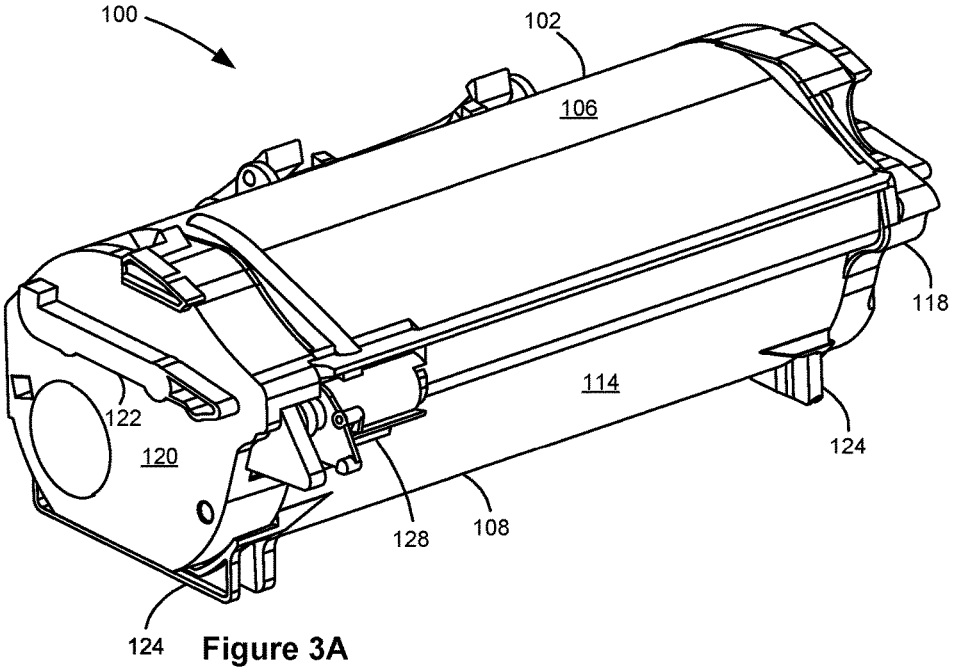
FIGS. 3A and 3B are additional perspective views of the toner cartridge shown in FIG. 2.
Figure 3B:
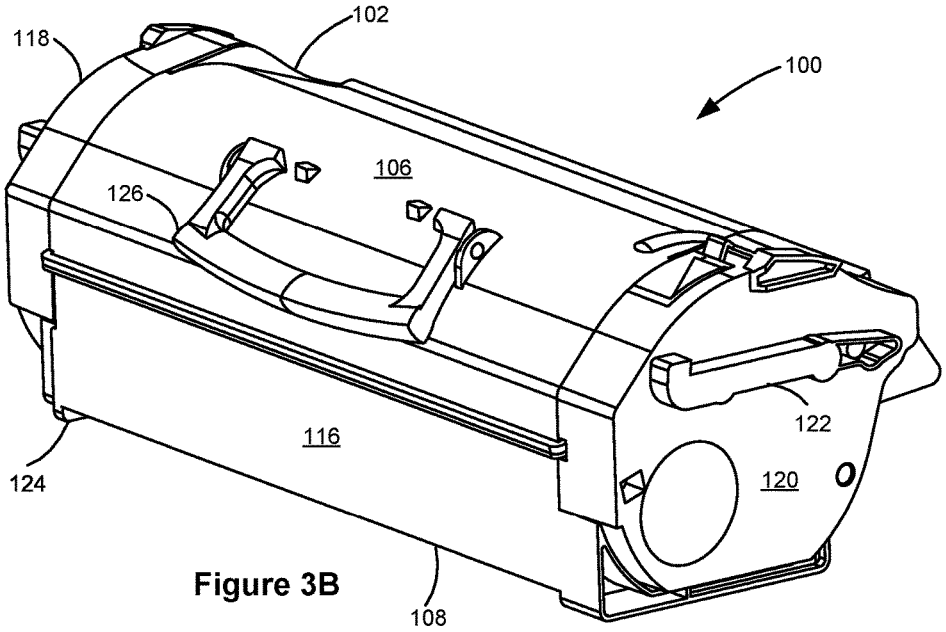
Figure 4:
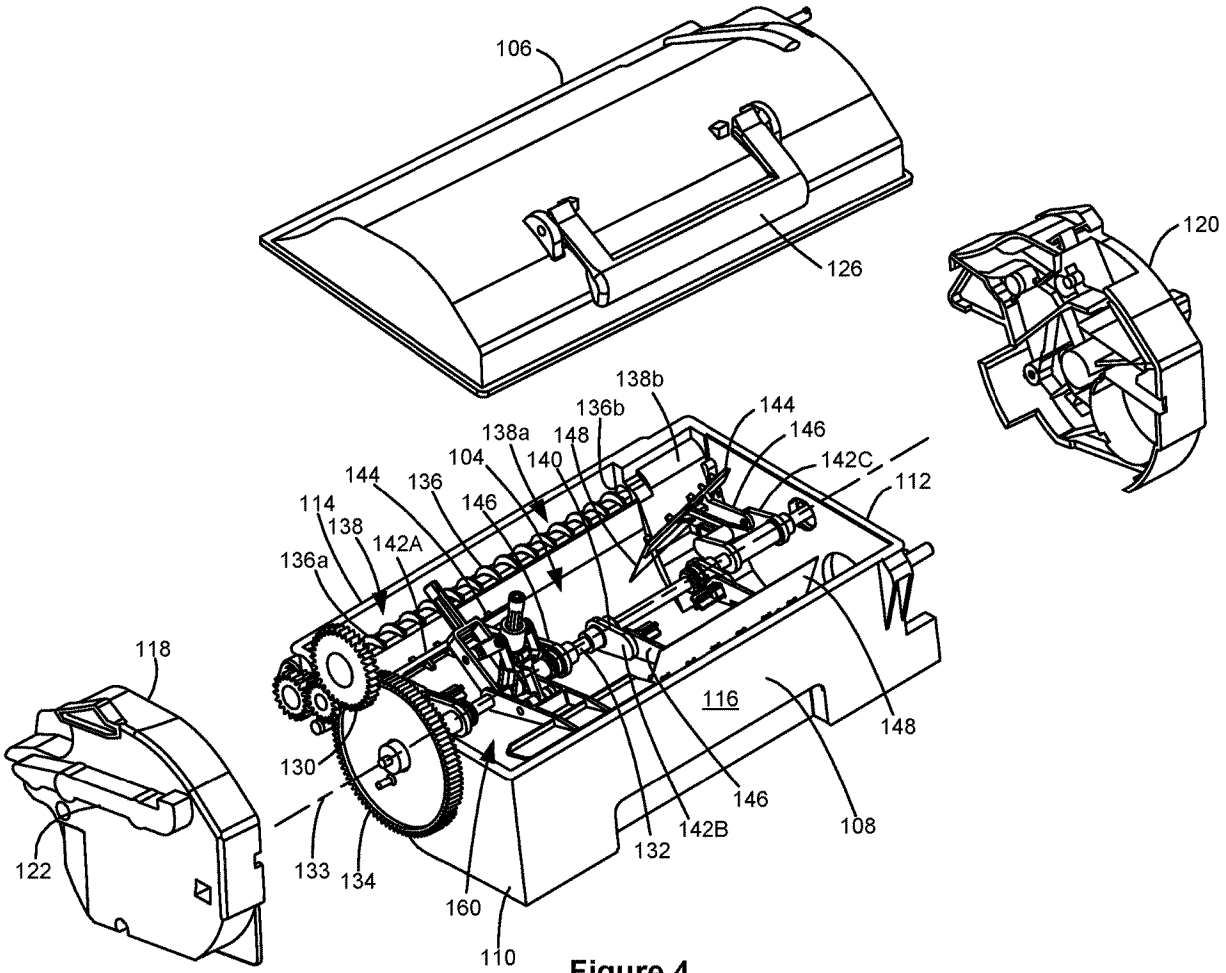
FIG. 4 is an exploded view of the toner cartridge shown in FIG. 2 showing a reservoir for holding toner therein.

With reference to FIGS. 2-4, toner cartridge 100 includes a housing 102 having an enclosed reservoir 104 (FIG. 4) for storing toner. Housing 102 may include a top or lid 106 mounted on a base 108. Base 108 includes first and second side walls 110, 112 connected to adjoining front and rear walls 114, 116 and a bottom 117. In one embodiment, top 106 is ultrasonically welded to base 108 thereby forming enclosed reservoir 104. First and second end caps 118, 120 may be mounted to side walls 110, 112, respectively, and may include guides 122 to assist the insertion of toner cartridge 100 into image forming device 22 for mating with developer unit 202. First and second end caps 118, 120 may be snap fitted into place or attached by screws or other fasteners. Guides 122 travel in corresponding channels within image forming device 22. Legs 124 may also be provided on bottom 117 of base 108 or end caps 118, 120 to assist with the insertion of toner cartridge 100 into image forming device 22. Legs 124 are received by frame 206 to facilitate the mating of toner cartridge 100 with developer unit 202. A handle 126 may be provided on top 106 or base 108 of toner cartridge 100 to assist with insertion and removal of toner cartridge 100 from imaging unit 200 and image forming device 22. An outlet port 128 is positioned on front wall 114 of toner cartridge 100 for exiting toner from toner cartridge 100.

With reference to FIG. 4, various drive gears are housed within a space formed between end cap 118 and side wall 110. A main interface gear 130 engages with a drive system in image forming device 22 that provides torque to main interface gear 130. A paddle assembly 140 is rotatably mounted within toner reservoir 104 with first and second ends of a drive shaft 132 of paddle assembly 140 extending through aligned openings in side walls 110, 112, respectively. A drive gear 134 is provided on the first end of drive shaft 132 that engages with main interface gear 130 either directly or via one or more intermediate gears. Bushings and seals may be provided on each end of drive shaft 132 where it passes through side walls 110, 112.

An auger 136 having first and second ends **136*a*, 136*b* and a spiral screw flight is positioned in a channel 138 extending along the width of front wall 114 between side walls 110, 112. Channel 138 may be integrally molded as part of front wall 114 or formed as a separate component that is attached to front wall 114. Channel 138 is generally horizontal in orientation along with toner cartridge 100 when toner cartridge 100 is installed in image forming device 22. First end 136*a* of auger 136 extends through side wall 110 and a drive gear (not shown) is provided on first end 136*a* that engages with main interface gear 130 either directly or via one or more intermediate gears. Channel 138 may include an open portion 138*a* and an enclosed portion 138*b*. Open portion 138*a* is open to toner reservoir 104 and extends from side wall 110 toward second end 136*b* of auger 136. Enclosed portion 138*b* of channel 138 extends from side wall 112 and encloses an optional shutter and second end 136*b* of auger 136. In this embodiment, outlet port 128 is positioned at the bottom of enclosed portion 138*b* of channel 138 so that gravity will assist in exiting toner through outlet port 128. The shutter is movable between a closed position blocking toner from exiting outlet port 128 and an open position permitting toner to exit outlet port 128**.

Paddle assembly 140 is rotatable with shaft 132 to stir and move toner stored in reservoir 104. In the example embodiment illustrated, paddle assembly 140 includes paddles 142A, 142B and 142C mounted along shaft 132 that stir and mix the toner in reservoir 104. In the example embodiment illustrated, each paddle 142A, 142B, 142C includes a cross-beam 144 positioned at a distal end of a corresponding arm 146 that extends radially from shaft 132. A flexible scraper 148 may extend in a cantilevered manner from each cross-beam 144. Scrapers 148 are formed from a flexible material and form an interference fit with the inner surfaces of top 106, front wall 114, rear wall 116 and bottom 117 to wipe toner from the inner surfaces of reservoir 104. Scrapers 148 also push toner into open portion 138*a* of channel 138 as shaft 132 rotates. The arrangement of paddles 142A-142C shown in FIG. 4 is not intended to be limiting. For example, the paddles utilized may include any suitable combination of projections, agitators, scrapers and linkages to agitate and move the toner stored in reservoir 104 as desired. Further, while the example embodiment illustrated includes three paddles 142A-142C, any number of paddles may be used as desired.

As paddle assembly 140 rotates, it delivers toner from toner reservoir 104 into open portion 138*a* of channel 138. As auger 136 rotates, it delivers toner received in channel 138 into enclosed portion 138*b* of channel 138 where the toner passes out of outlet port 128 into a corresponding entrance port 208 in developer unit 202 (FIG. 2). In one embodiment, entrance port 208 of developer unit 202 is surrounded by a foam seal 210 that traps residual toner and prevents toner leakage at the interface between outlet port 128 and entrance port 208.

In one example embodiment, a toner level sensing assembly 160 is connected to shaft 132 that allows a sensor to detect the amount of toner in reservoir 104 as discussed in greater detail below. Toner level sensing assembly 160 is shown positioned next to side wall 110 but may be positioned elsewhere in reservoir 104 so long as paddles 142A-142C of paddle assembly 140 do not interfere with the motion of toner level sensing assembly 160. Toner level sensing assembly 160 is rotatable around an axis of rotation 133 of shaft 132 and changes angular orientation as paddle assembly 140 rotates depending on the amount of toner in reservoir 104. Toner level sensing assembly 160 operates in conjunction with a sensor that detects and/or monitors angular positions of rotating components of toner level sensing assembly 160 as paddle assembly 140 rotates. The angular positions of rotating components of toner level sensing assembly 160 correlate with the amount of toner in reservoir 104 such that by detecting the angular positions of the rotating components of toner level sensing assembly 160, continual toner level sensing in reservoir 104 may be achieved as discussed in greater detail below.

The drive system in image forming device 22 includes a drive motor and a drive transmission from the drive motor to a drive gear that mates with main interface gear 130 when toner cartridge 100 is installed in image forming device 22. The drive system in image forming device 22 may include an encoded device, such as an encoder wheel, (e.g., coupled to a shaft of the drive motor) and an associated code reader, such as an infrared sensor, to sense the motion of the encoded device. The code reader is in communication with controller 28 in order to permit controller 28 to track the amount of rotation of main interface gear 130, auger 136, shaft 132 and paddle assembly 140.

Figure 5A:
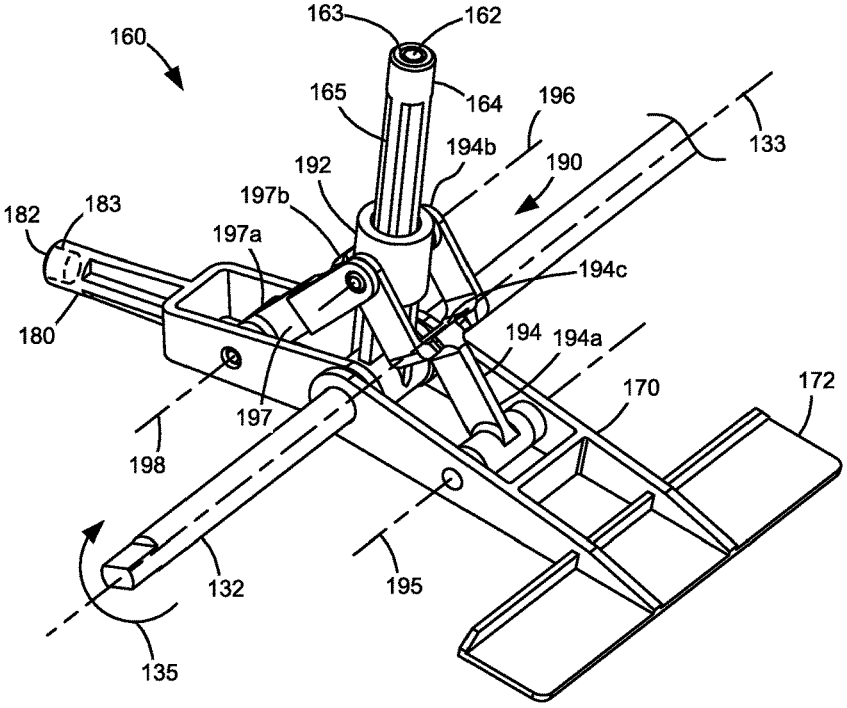
FIGS. 5A and 5B are perspective views of a toner level sensing assembly of the toner cartridge in an open position and a closed position, respectively, according to one example embodiment.
Figure 5B:
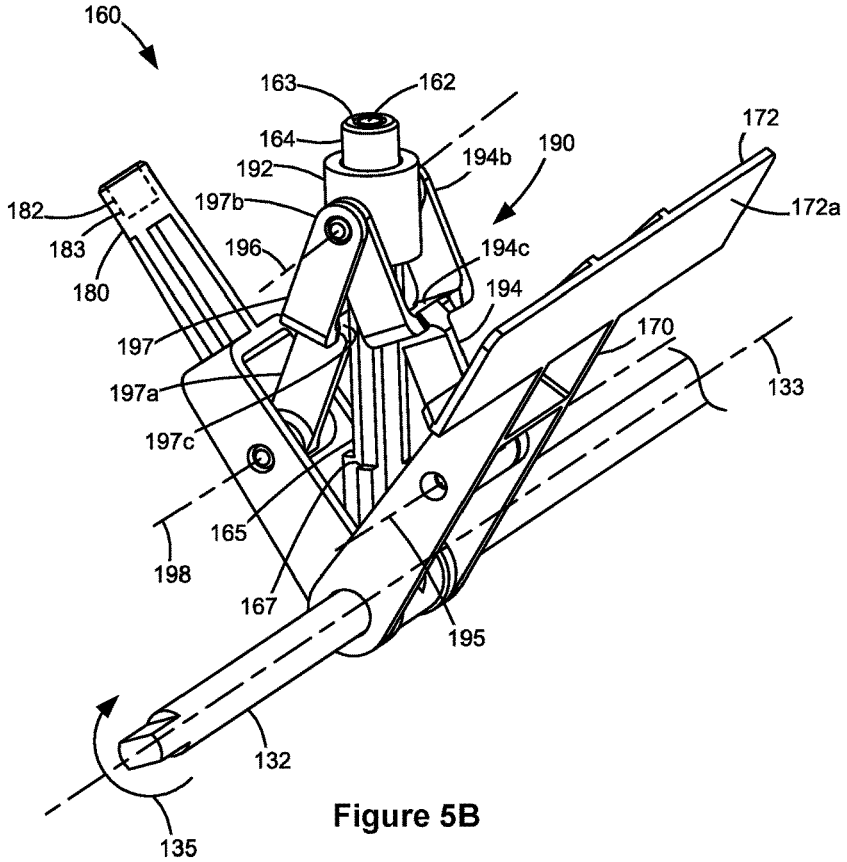

FIGS. 5A and 5B show toner level sensing assembly 160 in greater detail according to one example embodiment. In operation, shaft 132 rotates in an operative rotational direction 135. In the example embodiment illustrated, a first permanent magnet 162 is rotatable with shaft 132 and detectable by a magnetic sensor 220 (see FIG. 6). In one embodiment, first magnet 162 is connected to shaft 132 by a fixed arm 164 that is fixed to shaft 132 such that fixed arm 164 rotates with shaft 132. In one embodiment, first magnet 162 is positioned at a radially outermost portion of fixed arm 164 which extends in close proximity to but does not contact the inner surfaces of housing 102 so that first magnet 162 is positioned in close proximity to the inner surfaces of housing 102. In one embodiment, first magnet 162 is held by a friction fit in a cavity 163 in fixed arm 164. First magnet 162 may also be attached to fixed arm 164 using an adhesive or fastener(s) so long as first magnet 162 will not dislodge from fixed arm 164 during operation of toner cartridge 100. First magnet 162 may be any suitable size and shape so as to be detectable by magnetic sensor 220. First magnet 162 may be composed of any suitable permanent magnet material such as a bonded ferrite magnet, a ceramic ferrite magnet, an Alnico magnet, a neodymium magnet, a samarium cobalt magnet, etc.

A paddle arm 170 is connected to shaft 132 and leads fixed arm 164 and first magnet 162 in operative rotational direction 135 of shaft 132. Paddle arm 170 is rotatable around axis of rotation 133 of shaft 132 independent of shaft 132 within a predetermined angular range of motion relative to shaft 132. In the example embodiment illustrated, paddle arm 170 rotates with shaft 132 but is movable to a certain degree independent of shaft 132. For example, paddle arm 170 is free to rotate forward and backward on shaft 132 relative to fixed arm 164 and to first magnet 162 between a forward rotational stop (as shown in FIG. 5A) and a rearward rotational stop (as shown in FIG. 5B). An angular separation or offset between fixed arm 164 (and first magnet 162) and paddle arm 170 varies depending on a rotational position of paddle arm 170 relative to its forward rotational stop and rearward rotational stop. Paddle arm 170 includes a leading paddle member 172 having a paddle surface 172*a* that engages toner in reservoir 104 as discussed in greater detail below. In the example embodiment illustrated, paddle surface 172*a* is substantially planar and normal to the direction of motion of paddle arm 170 to allow paddle surface 172*a* to strike toner in reservoir 104. In other embodiments, leading paddle member 172 may be any suitable size and shape that provide leading paddle member 172 with enough surface area to cause leading paddle member 172 to land softly on toner in reservoir 104 and to stop paddle arm 170 from freely rotating when paddle surface 172 contacts toner in reservoir 104 as discussed in greater detail below.

A sense arm 180 is also connected to shaft 132 and trails fixed arm 164 and first magnet 162 in operative rotational direction 135 of shaft 132. Sense arm 180 is rotatable around axis of rotation 133 of shaft 132 independent of shaft 132 within a predetermined angular range of motion relative to shaft 132. In the example embodiment illustrated, sense arm 180 is free to rotate forward and backward on shaft 132 relative to fixed arm 164 and to first magnet 162 between a forward rotational stop (as shown in FIG. 5B) and a rearward rotational stop (as shown in FIG. 5A). An angular offset between fixed arm 164 (and first magnet 162) and sense arm 180 varies depending on a rotational position of sense arm 180 relative to its forward rotational stop and rearward rotational stop.

Sense arm 180 includes a second permanent magnet 182 detectable by magnetic sensor 220. In the example embodiment illustrated, second magnet 182 is positioned at a radially outermost portion of sense arm 180 which extends in close proximity to but does not contact the inner surfaces of housing 102. In this manner, second magnet 182 is positioned in close proximity to the inner surfaces of housing 102 but the inner surfaces of housing 102 do not impede the motion of sense arm 180. In one embodiment, second magnet 182 may be held by a friction fit in a cavity 183 in sense arm 180. Second magnet 182 may also be attached to sense arm 180 using an adhesive or fastener(s) so long as second magnet 182 will not dislodge from sense arm 180 during operation of toner cartridge 100. As with first magnet 162, second magnet 182 may be any suitable size and shape and composed of any suitable material. In some embodiments, second magnet 182 may be made similar in construction to first magnet 162. Second magnet 182 is substantially radially and axially aligned and spaced circumferentially from first magnet 162 relative to shaft 132. In one embodiment, a sufficient amount of spacing between first magnet 162 and second magnet 182 may be maintained so that they do not magnetically interact in a manner that prevents paddle arm 170 and sense arm 180 from moving freely and to allow magnetic sensor 220 to separately detect first magnet 162 and second magnet 182. In another embodiment, first and second magnets 162, 182 may be oriented to have the same polarity so that they repel each other.

Paddle arm 170 is operatively connected to sense arm 180 such that paddle arm 170 and sense arm 180 are movable together between an open position (as shown in FIG. 5A) and a closed position (as shown in FIG. 5B) relative to fixed arm 164. In the open position, paddle arm 170 is rotated to its forward rotational stop and sense arm 180 is rotated to its rearward rotational stop such that the angular offset between fixed arm 164 and paddle arm 170 and the angular offset between fixed arm 164 and sense arm 180 are at their maximums. In the closed position, paddle arm 170 is rotated to its rearward rotational stop and sense arm 180 is rotated to its forward rotational stop such that the angular offset between fixed arm 164 and paddle arm 170 and the angular offset between fixed arm 164 and sense arm 180 are at their minimums. Paddle arm 170 and sense arm 180 are operatively connected such that an amount of angular offset between fixed arm 164 and sense arm 180 increases as an amount of angular offset between fixed arm 164 and paddle arm 170 increases and, conversely, the amount of angular offset between fixed arm 164 and sense arm 180 decreases as the amount of angular offset between fixed arm 164 and paddle arm 170 decreases. In one embodiment, paddle arm 170 and sense arm 180 are operatively connected such that the amount of angular offset between fixed arm 164 and paddle arm 170 is equal to the amount of angular offset between fixed arm 164 and sense arm 180.

In the example embodiment illustrated, a linkage assembly 190 connects paddle arm 170 and sense arm 180. Linkage assembly 190 includes a collar 192 mounted about fixed arm 164 and movable along the length of fixed arm 164. Fixed arm 164 includes ribs 165 to improve the moldability of fixed arm 164 and to reduce surface contact between collar 192 and fixed arm 164 as collar 192 moves along fixed arm 164. Fixed arm 164 also includes a stop 167 that contacts collar 192 to limit the motion of collar 192 along fixed arm 164 toward shaft 132. Paddle arm 170 is connected to collar 192 by a first link 194 having a first end 194*a* pivotably attached to paddle arm 170 about a pivot axis 195 and a second end 194*b* pivotably attached to collar 192 about a pivot axis 196. Sense arm 180 is connected to collar 192 by a second link 197 having a first end 197*a* pivotably attached to sense arm 180 about a pivot axis 198 and a second end 197*b* pivotably attached to collar 192 about pivot axis 196. The arrangement of linkage assembly 190 allows collar 192 to travel along fixed arm 164 as paddle arm 170 and sense arm 180 move between their respective forward rotational stops and rearward rotational stops. In one embodiment, first link 194 and second link 197 are substantially equal in length and are attached at a common radial point on fixed arm 164 and common radial points on paddle arm 170 and sense arm 180 such that respective angular offsets of paddle arm 170 and sense arm 180 relative to fixed arm 164 remain equal to each other as paddle arm 170 and sense arm 180 move between their respective forward rotational stops and rearward rotational stops. In one example, the angular offset between fixed arm 164 and paddle arm 170 when paddle arm 170 is at the forward rotational stop and the angular offset between fixed arm 164 and sense arm 180 when sense arm 180 is at the rearward rotational stop are each about 100 degrees.

Paddle arm 170 is free to fall by gravity toward its forward rotational stop and sense arm 180 is free to fall by gravity toward its rearward rotational stop as fixed arm 164 rotates past the uppermost point of its rotational path, such as when there is no toner resistance against paddle arm 170 and gravity causes linkage assembly 190 to slide to the open position. In other embodiments, paddle arm 170 and sense arm 180 may be spring biased toward the forward rotational stop of paddle arm 170 and the rearward rotational stop of sense arm 180 in order to aid gravity in moving paddle arm 170 and sense arm 180 to the open position. In the example embodiment illustrated, the forward rotational stop of paddle arm 170 and the rearward rotational stop of sense arm 180 are defined by stop 167 which obstructs the motion of collar 192 along fixed arm 164 to limit the rotational motion of paddle arm 170 and sense arm 180 away from fixed arm 164. In the example embodiment illustrated, the rearward rotational stop of paddle arm 170 and the forward rotational stop of sense arm 180 are defined by respective portions 194*c*, 197*c* of first and second links 194, 197 contacting fixed arm 164 to limit the rotational motion of paddle arm 170 and sense arm 180 toward fixed arm 164. In particular, portion 194*c* of first link 194 contacts fixed arm 164 to limit the motion of paddle arm 170 relative to fixed arm 164 in a direction opposite operative rotational direction 135 and portion 197*c* of second link 197 contacts fixed arm 164 to limit the motion of sense arm 180 relative to fixed arm 164 in operative rotational direction 135. It will be appreciated that the forward and rearward rotational stops may take other forms as desired. For example, in another embodiment, a stop positioned near the radial end of fixed arm 164 limits the motion of collar 192 away from shaft 132 thereby limiting the rotational motion of paddle arm 170 and sense arm 180 toward fixed arm 164.

FIGS. 6-8E depict the operation of first magnet 162 and second magnet 182 at various toner levels. FIGS. 6-8E depict a clock face in dashed lines along the rotational path of shaft 132 and paddle assembly 140 in order to aid in the description of the operation of first magnet 162 and second magnet 182. Magnetic sensor 220 is positioned to continually detect the motion of first and second magnets 162, 182 during rotation of shaft 132 in order to determine the amount of toner remaining in reservoir 104 as discussed in greater detail below. In one embodiment, magnetic sensor 220 is mounted on housing 102 of toner cartridge 100. In this embodiment, magnetic sensor 220 may be in electronic communication with processing circuitry 45 of toner cartridge 100 so that information from magnetic sensor 220 can be sent to controller 28 of image forming device 22. Alternatively, electrical contacts on the outer surface of housing 102 may contact corresponding electrical contacts in image forming device 22 when toner cartridge 100 is installed in image forming device 22 in order to facilitate communication between magnetic sensor 220 and controller 28. In another embodiment, magnetic sensor 220 is positioned on a portion of image forming device 22 adjacent to housing 102 when toner cartridge 100 is installed in image forming device 22. In this embodiment, magnetic sensor 220 is in electronic communication with controller 28. Magnetic sensor 220 is positioned near or on the outer surface of housing 102 such that magnets 162, 182 pass in close proximity to magnetic sensor 220 as shaft 132 rotates. In the example embodiment illustrated, magnetic sensor 220 is positioned adjacent to or on top 106 of housing 102. Magnetic sensor 220 may be any suitable device capable of detecting the presence or absence of a magnetic field. For example, magnetic sensor 220 may be a hall-effect sensor, which is a transducer that varies its electrical output in response to a magnetic field.

The motion of sense arm 180 and second magnet 182 relative to first magnet 162 on fixed arm 164 as shaft 132 rotates may be used to estimate the amount of toner remaining in reservoir 104. As shaft 132 rotates, in the embodiment illustrated, fixed arm 164 rotates with shaft 132 causing first magnet 162 to pass magnetic sensor 220 at the same point during each revolution of shaft 132. On the other hand, the motion of sense arm 180, which is free to rotate relative to shaft 132 between its forward and rearward rotational stops, depends on the amount of toner 105 present in reservoir 104. As a result, second magnet 182 passes magnetic sensor 220 at different points relative to first magnet 162 during the revolution of shaft 132 depending on the toner level in reservoir 104. Accordingly, variation in the angular separation or offset between first magnet 162, which serves as a reference point, and second magnet 182, which provides a sense point, as they pass magnetic sensor 220 may be used to determine the amount of toner remaining in reservoir 104. In one example embodiment, detection of first magnet 162 on fixed arm 164 by magnetic sensor 220 triggers controller 28 to start measuring the amount of rotation of shaft 132 and detection of second magnet 182 on sense arm 180 by magnetic sensor 220 indicates the end of measurement of the amount of rotation of shaft 132. Controller 28 is configured to calculate an amount of rotation of shaft 132 between the start and end of measurement and to determine an amount of toner remaining based on the amount of rotation of shaft 132 that occurs between sensing first magnet 162 and sensing second magnet 182. In this manner, the angular separation between first magnet 162 and second magnet 182 passing magnetic sensor 220 is measured by determining the amount of rotation of shaft 132 between magnetic sensor 220 detecting first magnet 162 and magnetic sensor 220 detecting second magnet 182. The amount of rotation of shaft 132 may of course be measured or calculated directly or indirectly, such as by measuring the rotation of the drive motor of image forming device 22 that provides rotational force to main interface gear 130. For example, controller 28 may track a number of pulses from the code reader of the encoded device of the drive motor in image forming device 22 discussed above in order to determine an amount of rotation of shaft 132 between magnetic sensor 220 detecting first magnet 162 and magnetic sensor 220 detecting second magnet 182.

Figure 6:
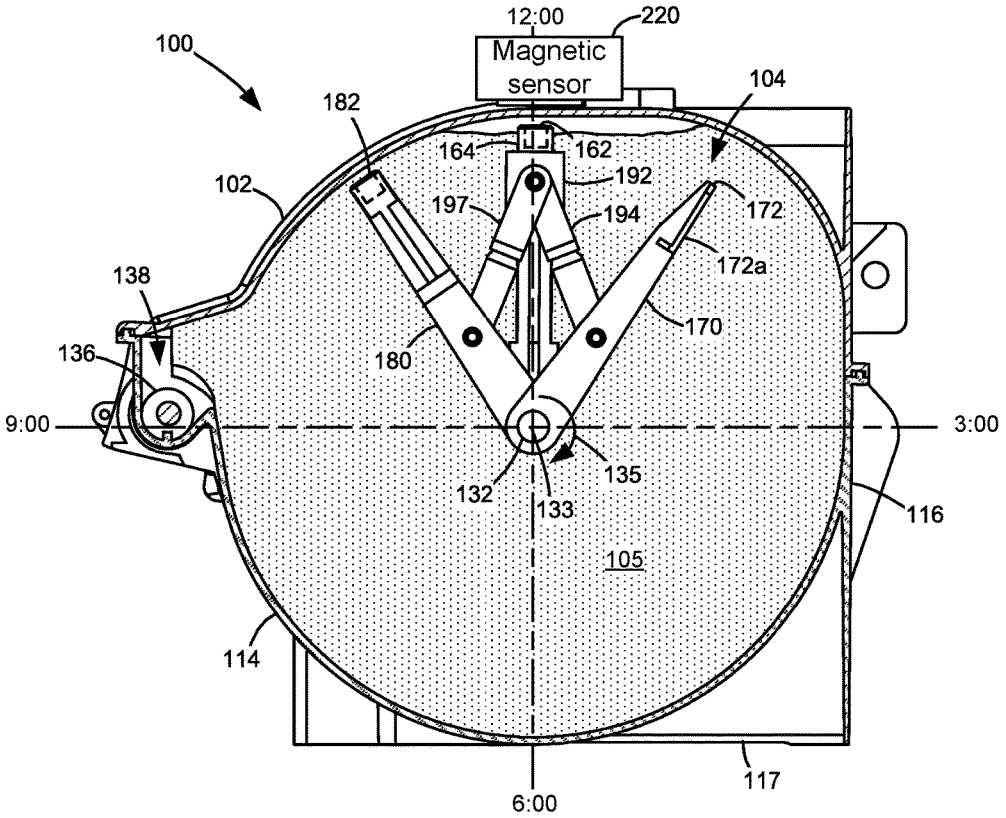
FIG. 6 is cross-sectional side view of the toner cartridge illustrating the toner level sensing assembly at a relatively full toner level according to one example embodiment.

When toner reservoir 104 is relatively full as shown in FIG. 6, toner 105 present in reservoir 104 prevents paddle arm 170 from rotating freely about shaft 132. Instead, toner resistance against paddle arm 170 causes paddle arm 170 to remain at its rearward rotational stop. As a result, sense arm 180 remains at its forward rotational stop due to the connection of paddle arm 170 to sense arm 180 via linkage assembly 190 as toner 105 pushes paddle arm 170 against its rearward rotational stop. When shaft 132 rotates, paddle arm 170 is pushed through its rotational path by fixed arm 164 with sense arm 180 trailing behind fixed arm 164. Accordingly, when toner reservoir 104 is relatively full as shaft 132 rotates, paddle arm 170 and sense arm 180 rotate at the same rate as fixed arm 164 around axis of rotation 133. Toner 105 prevents paddle arm 170 from advancing ahead of its rearward rotational stop and keeps sense arm 180 at its forward rotational stop. Because sense arm 180 is at its forward rotational stop, the angular separation between first magnet 162 and second magnet 182 when second magnet 182 reaches magnetic sensor 220 is at its minimum limit. As a result, the amount of rotation of shaft 132 between magnetic sensor 220 detecting first magnet 162 on fixed arm 164 and magnetic sensor 220 detecting second magnet 182 on sense arm 180 is at its minimum.

Figure 7A:
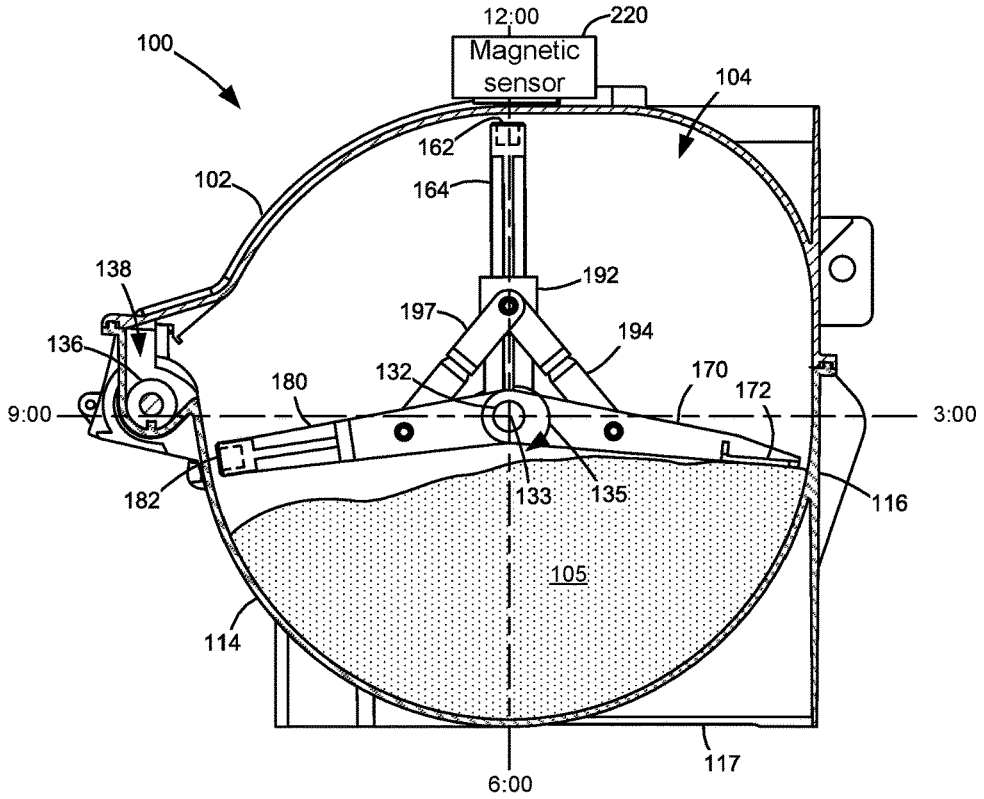
FIGS. 7A and 7B are cross-sectional side views of the toner cartridge illustrating the operation of the toner level sensing assembly at a relatively half-full toner level according to one example embodiment.
Figure 7B:
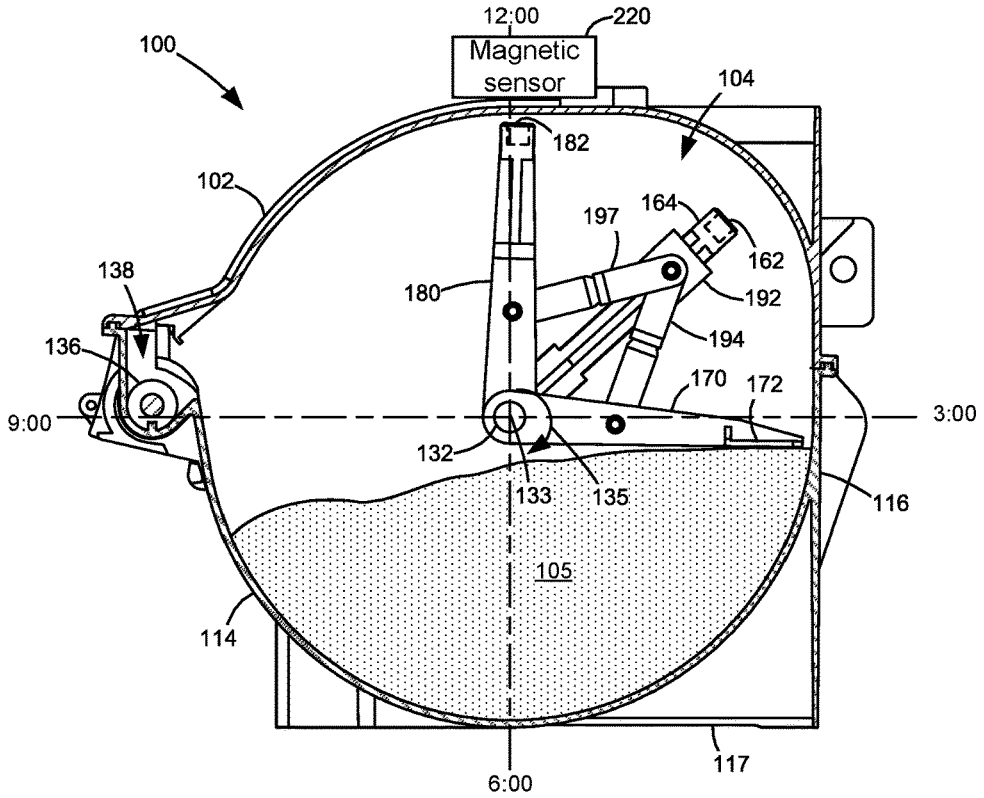

As the toner level in reservoir 104 decreases as shown in FIGS. 7A and 7B, as paddle arm 170 is pushed through the upper vertical position of rotation (the "12 o'clock" position) by fixed arm 164, paddle arm 170 tends to separate from fixed arm 164 and fall freely ahead of the rearward rotational stop of paddle arm 170 (toward the "3 o'clock" position) faster than fixed arm 164 is being driven by shaft 132 due to the weight of paddle arm 170 and sense arm 180. Paddle arm 170 falls forward until, depending on the amount of toner in reservoir 104, paddle surface 172*a* of leading paddle member 172 contacts toner 105, which stops the rotational advance of paddle arm 170, or until paddle arm 170 reaches its forward rotational stop. In the example illustrated in FIGS. 7A and 7B, the amount of toner 105 in reservoir 104 allows paddle arm 170 to reach its forward rotational stop before contacting toner 105. At toner levels higher than the toner level illustrated in FIGS. 7A and 7B, paddle arm 170 is stopped by toner 105 before paddle arm 170 reaches its forward rotational stop. Upon paddle arm 170 reaching its forward rotational stop, paddle arm 170 may tend to rotate at the same rate as fixed arm 164 around axis of rotation 133 until paddle arm 170 contacts toner 105 as shown in FIG. 7A. The connection between paddle arm 170 and sense arm 180 via linkage assembly 190 causes sense arm 180 to pivot away from fixed arm 164 toward the rearward rotational stop of sense arm 180 as paddle arm 170 pivots away from fixed arm 164 toward the forward rotational stop of paddle arm 170. Accordingly, the angular offset between fixed arm 164 and sense arm 180 increases as the angular offset between fixed arm 164 and paddle arm 170 increases. In one embodiment, the configuration of linkage assembly 190 allows the amount of angular offset between fixed arm 164 and sense arm 180 and the amount of angular offset between fixed arm 164 and paddle arm 170 to remain equal as paddle arm 170 and sense arm 180 each move away from fixed arm 164.

After paddle arm 170 contacts toner 105, paddle arm 170 remains generally stationary on top of (or slightly below the surface of) toner 105 while fixed arm 164 continues to advance with shaft 132 in operative rotational direction 135 until fixed arm 164 catches up to paddle arm 170 and paddle arm 170 reaches its rearward rotational stop. While leading paddle member 172 of paddle arm 170 is stopped by and remains generally stationary on top of toner 105, paddle arm 170 and sense arm 180 both pivot toward fixed arm 164 as shaft rotates 132 until paddle arm 170 reaches its rearward rotational stop and sense arm 180 reaches its forward rotational stop. In this manner, as the angular offset between fixed arm 164 and paddle arm 170 decreases, the angular offset between fixed arm 164 and sense arm 180 also decreases as a result of the connection provided by linkage assembly 190. Specifically, while leading paddle member 172 of paddle arm 170 is stopped by toner 105 and fixed arm 164 rotates with shaft 132 towards paddle arm 170, first link 194 connected between fixed arm 164 and paddle arm 170 causes collar 192 to slide up fixed arm 164, which, in turn, causes second link 197 to pull sense arm 180 toward fixed arm 164. Once paddle arm 170 reaches its rearward rotational stop, fixed arm 164 resumes pushing paddle arm 170 and sense arm 180 trails behind fixed arm 164 at the forward rotational stop of sense arm 180.

When leading paddle member 172 of paddle arm 170 has fallen ahead of fixed arm 164 and is stopped by toner 105, the movement of sense arm 180 away from its rearward rotational stop and toward its forward rotational stop causes second magnet 182 to pass magnetic sensor 220 at a point between the rearward and forward rotational stops of sense arm 180. At higher toner levels, second magnet 182 passes magnetic sensor 220 at a point closer to the forward rotational stop of sense arm 180 such that the angular separation between first magnet 162 and second magnet 182 when second magnet 182 reaches magnetic sensor 220 is closer to its minimum limit. At lower toner levels, second magnet 182 passes magnetic sensor 220 at a point closer to the rearward rotational stop of sense arm 180 such that the angular separation between first magnet 162 and second magnet 182 when second magnet 182 reaches magnetic sensor 220 is closer to its maximum limit. As a result, the amount of rotation of shaft 132 between magnetic sensor 220 detecting first magnet 162 on fixed arm 164 and magnetic sensor 220 detecting second magnet 182 on sense arm 180 varies depending on the amount of toner 105 in reservoir 104. At higher toner levels, paddle arm 170 is stopped by resistance from toner at a position closer to fixed arm 164 such that the amount of rotation of shaft 132 between magnetic sensor 220 detecting first magnet 162 on fixed arm 164 and magnetic sensor 220 detecting second magnet 182 on sense arm 180 is closer to its minimum. At lower toner levels, paddle arm 170 is stopped by resistance from toner at a position further from fixed arm 164 such that the amount of rotation of shaft 132 between magnetic sensor 220 detecting first magnet 162 on fixed arm 164 and magnetic sensor 220 detecting second magnet 182 on sense arm 180 is closer to its maximum.

Figure 8A:
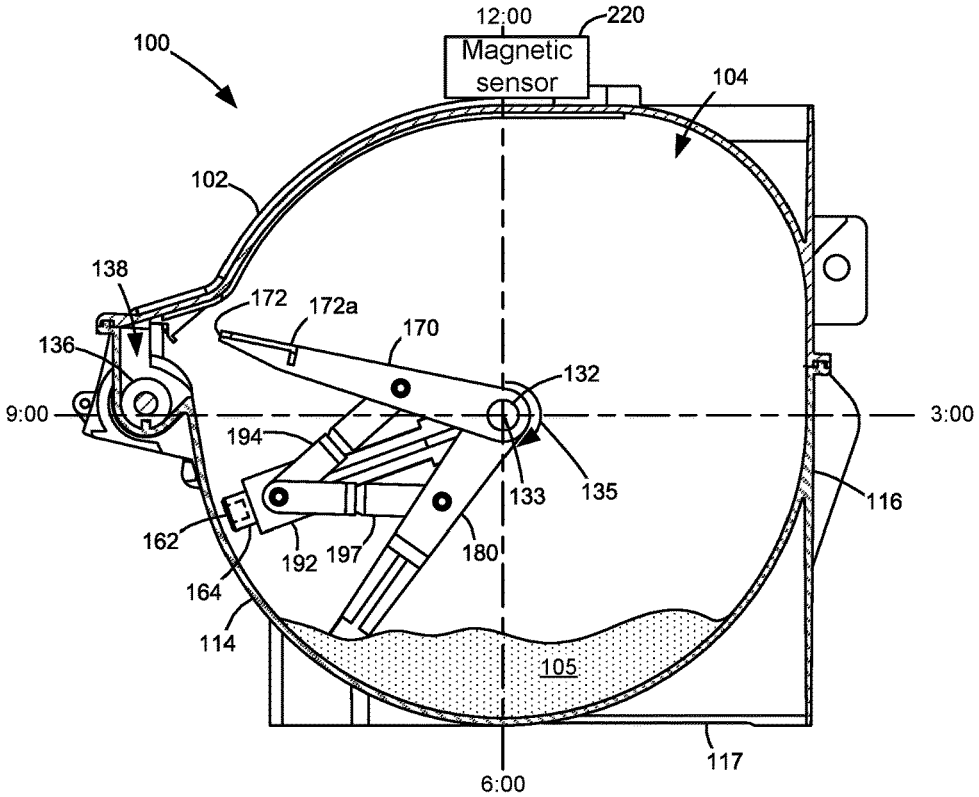
FIGS. 8A-8E are cross-sectional side views of the toner cartridge illustrating the operation of the toner level sensing assembly at a near empty toner level according to one example embodiment.
Figure 8B:
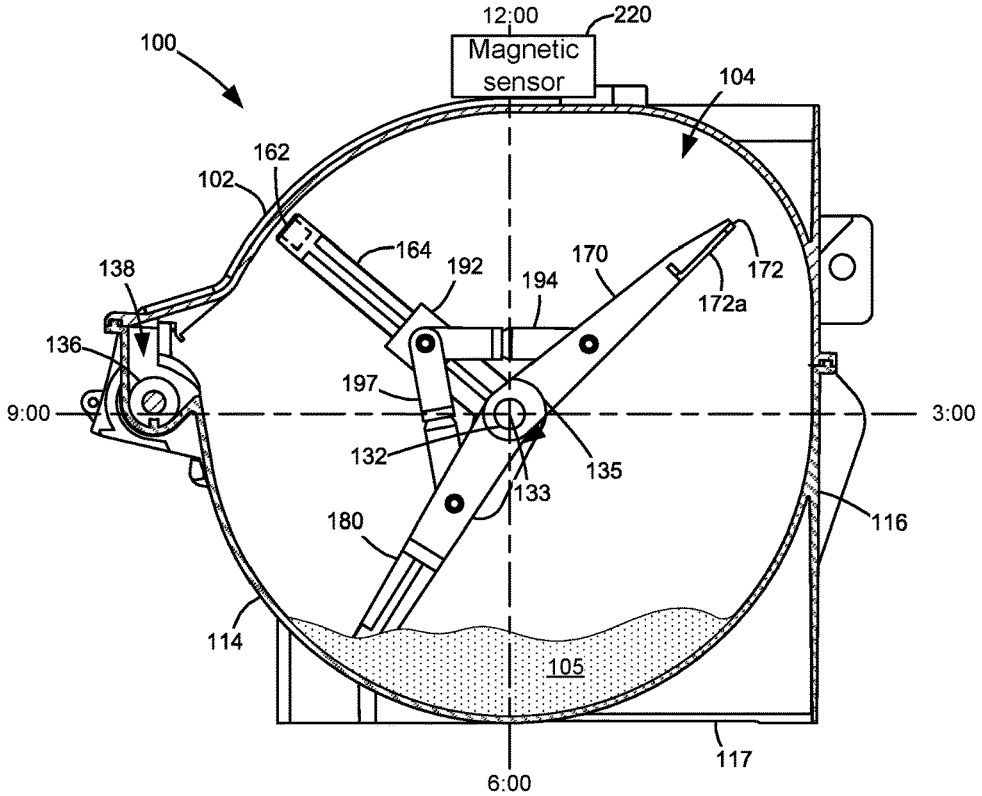
Figure 8C:
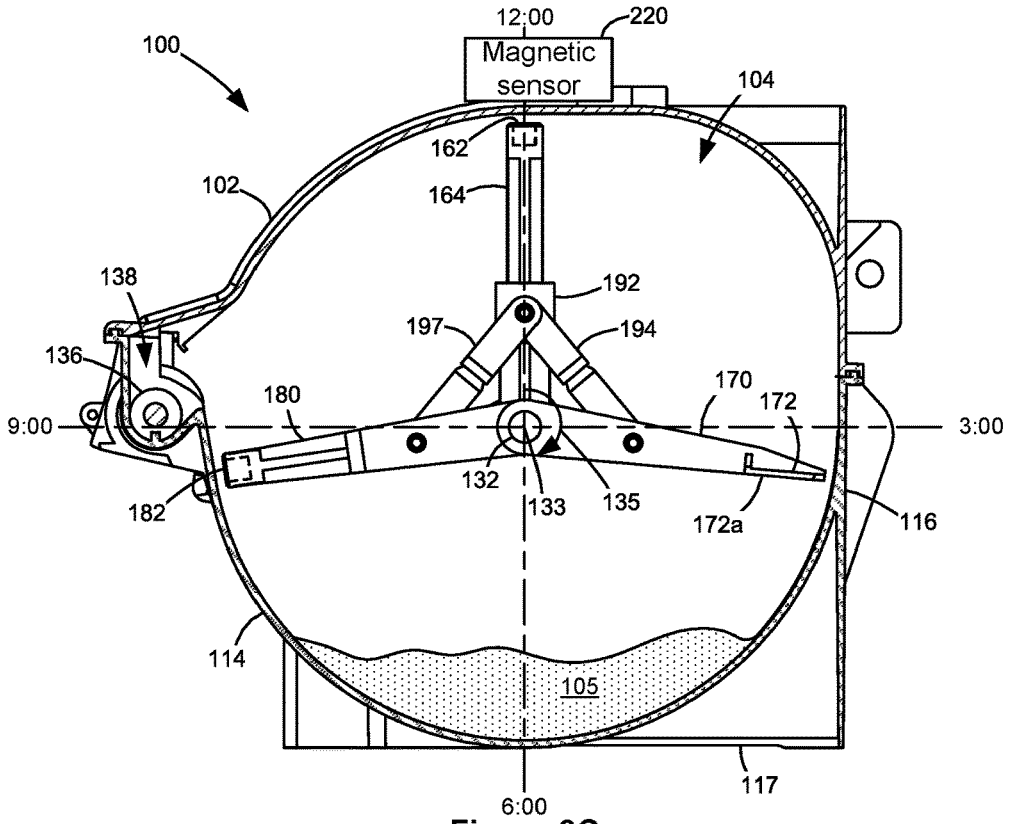
Figure 8D:
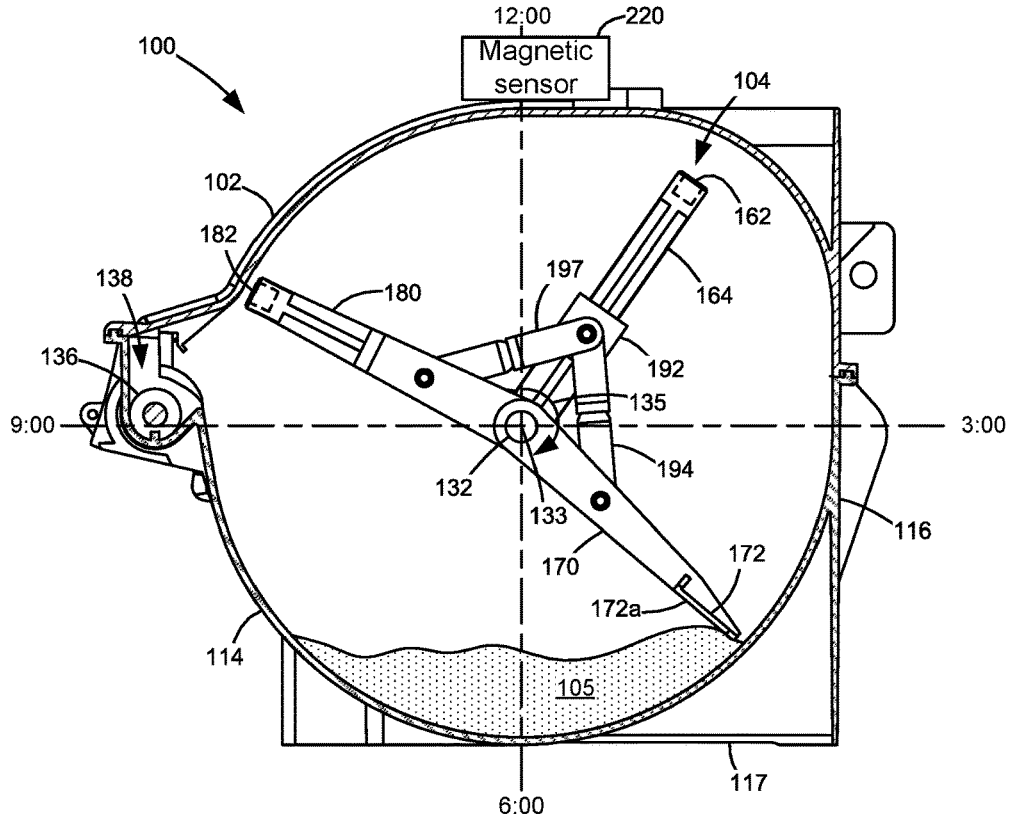
Figure 8E:
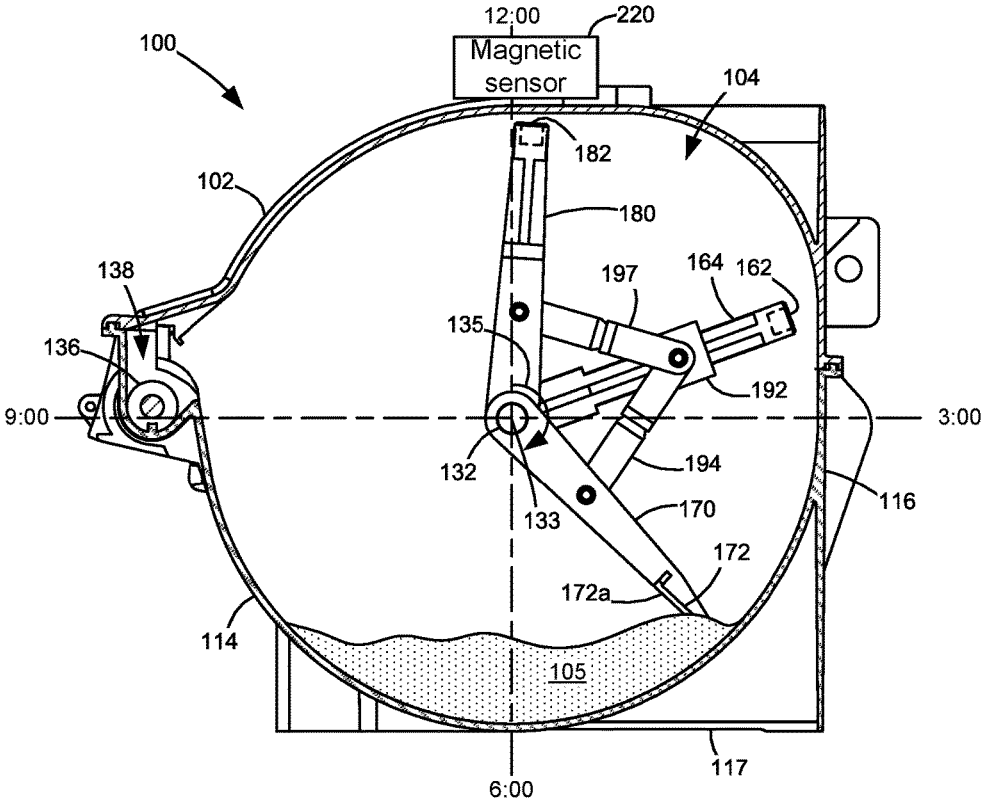

FIGS. 8A-8E illustrate the motion of toner level sensing assembly 160 when the toner level in reservoir 104 has decreased further relative to FIGS. 7A and 7B. As shown in FIG. 8A, paddle arm 170 and sense arm 180 remain in the closed position relative to fixed arm 164 due to gravity and the resistance of toner 105 as paddle arm 170 is pushed through the lower vertical position of rotation (the "6 o'clock" position) by fixed arm 164. In FIG. 8A, shaft 132 has rotated to a point where paddle arm 170 and fixed arm 164 have moved out of toner 105 while sense arm 180 remains in contact with toner 105. In FIG. 8B, shaft 132 has rotated to a point where fixed arm 164 has passed the "10 o'clock" position. At this position, in the example embodiment illustrated in FIG. 8B, fixed arm 164 has pushed paddle arm 170 through the upper vertical position of rotation (the "12 o'clock" position) and paddle arm 170 has fallen (toward the "3 o'clock" position) ahead of fixed arm 164 due to the weight of paddle arm 170 and sense arm 180, and paddle arm 170 has reached its forward rotational stop. Sense arm 180, in turn, has pivoted away from fixed arm 164 and reached the rearward rotational stop of sense arm 180 as a result of the connection to paddle arm 170 via linkage assembly 190 such that paddle arm 170 and sense arm 180 are in the open position relative to fixed arm 164. As shaft 132 rotates further from the position illustrated in FIG. 8B, paddle arm 170 and sense arm 180 rotate together with fixed arm 164 toward the position illustrated in FIG. 8C. In FIG. 8C, fixed arm 164 and first magnet 162 have reached the upper vertical position of rotation (the "12 o'clock" position) passing magnetic sensor 220. In FIG. 8D, as shaft 132 rotates further, paddle surface 172*a* of leading paddle member 172 contacts toner 105 which stops the rotational advance of paddle arm 170. As shaft 132 and fixed arm 164 continue to rotate while paddle arm 170 is stopped by toner 105, sense arm 180 pivots from the rearward rotational stop of sense arm 180 toward the forward rotational stop of sense arm 180 and second magnet 182 passes magnetic sensor 220 as shown in FIG. 8E. Sense arm 180 continues to pivot toward its forward rotational stop until sense arm 180 and paddle arm 170 reach their forward and rearward rotational stops, respectively, at which point paddle arm 170 and sense arm 180 are in the closed position relative to fixed arm 164. Fixed arm 164 then resumes pushing paddle arm 170 and the cycle repeats back to that shown in FIG. 8A.

Notably, the angular offset between second magnet 182 and first magnet 162 when second magnet 182 passes magnetic sensor 220 at the low toner level illustrated in FIG. 8E is greater than the angular offset between second magnet 182 and first magnet 162 when second magnet 182 passes magnetic sensor 220 at the higher toner level illustrated in FIG. 7B, which is, in turn, greater than the angular offset between second magnet 182 and first magnet 162 when second magnet 182 passes magnetic sensor 220 when reservoir 104 is full as illustrated in FIG. 6. As a result, the amount of rotation of shaft 132 between magnetic sensor 220 detecting first magnet 162 on fixed arm 164 and magnetic sensor 220 detecting second magnet 182 on sense arm 180 at the low toner level illustrated in FIG. 8E is greater than the amount of rotation of shaft 132 between magnetic sensor 220 detecting first magnet 162 and magnetic sensor 220 detecting second magnet 182 at the higher toner level illustrated in FIG. 7B, which is, in turn, greater than the amount of rotation of shaft 132 between magnetic sensor 220 detecting first magnet 162 and magnetic sensor 220 detecting second magnet 182 when reservoir 104 is full as illustrated in FIG. 6. Accordingly, it can be seen that the angular offset between second magnet 182 and first magnet 162 when second magnet 182 passes magnetic sensor 220 increases as the toner level in reservoir 104 decreases and that the amount of rotation of shaft 132 between magnetic sensor 220 detecting first magnet 162 and magnetic sensor 220 detecting second magnet 182 also increases as the toner level in reservoir 104 decreases.

Figure 9:
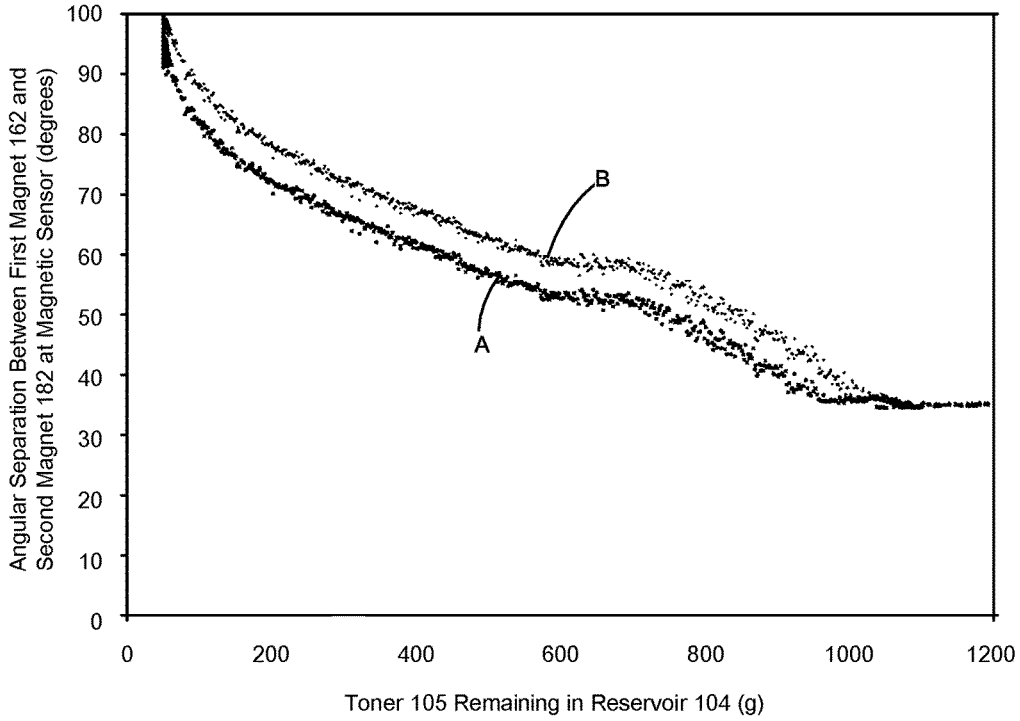
FIG. 9 is a graph of an angular separation between a reference magnet and a sense magnet versus an amount of toner remaining in the reservoir of the toner cartridge according to one example embodiment.

FIG. 9 is a graph of the angular separation between first magnet 162 and second magnet 182 at the point where magnetic sensor 220 detects second magnet 182 versus the amount of toner 105 remaining in reservoir 104 according to one example embodiment. Line A illustrates the angular separation between first magnet 162 entering the sensing window of magnetic sensor 220 and second magnet 182 entering the sensing window of magnetic sensor 220 versus the amount of toner 105 remaining in reservoir 104 and line B illustrates the angular separation between first magnet 162 leaving the sensing window of magnetic sensor 220 and second magnet 182 leaving the sensing window of magnetic sensor 220 versus the amount of toner 105 remaining in reservoir 104. Either or both of the detection signals from magnetic sensor 220 used to generate lines A and B may be used to determine the amount of toner 105 in reservoir 104. As shown in FIG. 9, at higher toner levels, the angular offset between first magnet 162 and second magnet 182 and, in turn, the amount of rotation of shaft 132 between magnetic sensor 220 detecting first magnet 162 and magnetic sensor 220 detecting second magnet 182 remains at its minimum. As the toner level in reservoir 104 decreases, the angular offset between first magnet 162 and second magnet 182 and, in turn, the amount of rotation of shaft 132 between magnetic sensor 220 detecting first magnet 162 and magnetic sensor 220 detecting second magnet 182 increases. When the toner level in reservoir 104 is nearly empty, in the example embodiment illustrated, lines A and B generally tilt toward the vertical as the toner volume decreases rapidly.

Information from magnetic sensor 220 may be used by controller 28 or processing circuitry in communication with controller 28, such as processing circuitry 45, to determine the amount of toner 105 remaining in reservoir 104. In one embodiment, the initial amount of toner 105 in reservoir 104 is recorded in memory associated with processing circuitry 45 upon filling the toner cartridge 100. Accordingly, upon installing toner cartridge 100 in image forming device 22, the processing circuitry determining the amount of toner 105 remaining in reservoir 104 is able to determine the initial toner level in reservoir 104. Alternatively, each toner cartridge 100 for a particular type of image forming device 22 may be filled with the same amount of toner so that the initial toner level in reservoir 104 used by the processing circuitry may be a fixed value for all toner cartridges 100. The toner level in reservoir 104 can be approximated by starting with the initial amount of toner 105 supplied in reservoir 104 and reducing the estimate of the amount of toner 105 remaining in reservoir 104 as toner 105 from reservoir 104 is consumed and as information is collected from magnetic sensor 220.

An empirical relationship between an amount of rotation of shaft 132 that occurs between magnetic sensor 220 detecting first magnet 162 and magnetic sensor 220 detecting second magnet 182 and an amount of toner remaining in reservoir 104 may be determined for a particular toner cartridge design. In one embodiment, because the amount of rotation of shaft 132 that occurs between magnetic sensor 220 detecting first magnet 162 and magnetic sensor 220 detecting second magnet 182 tends to provide an analog reading of the toner remaining in reservoir 104, a lookup table may be prepared based on the empirically determined relationship between the amount of rotation of shaft 132 that occurs between magnetic sensor 220 detecting first magnet 162 and magnetic sensor 220 detecting second magnet 182 and the amount of toner remaining in reservoir 104 such that an estimate of the amount of toner remaining in reservoir 104 may be determined quickly based on the amount of rotation of shaft 132 measured between magnetic sensor 220 detecting first magnet 162 and magnetic sensor 220 detecting second magnet 182. Alternatively, a polynomial equation may be fit to the empirically determined relationship between the amount of rotation of shaft 132 that occurs between magnetic sensor 220 detecting first magnet 162 and magnetic sensor 220 detecting second magnet 182 and the amount of toner remaining in reservoir 104. The processing circuitry may continually monitor the amount of rotation of shaft 132 between magnetic sensor 220 detecting first magnet 162 and magnetic sensor 220 detecting second magnet 182 as shaft 132 rotates and may continually update the estimate of the amount of toner remaining in reservoir 104 over the life of toner cartridge 100 based on the information from magnetic sensor 220.

In other embodiments, the amount of rotation of shaft 132 that occurs between magnetic sensor 220 detecting first magnet 162 and magnetic sensor 220 detecting second magnet 182 may be used in combination with other operating conditions of image forming device 22 and/or toner cartridge 100 to estimate the amount of toner remaining in reservoir 104. For example, an empirically derived feed rate of toner 105 from toner reservoir 104 when shaft 132 and auger 136 are rotated to deliver toner from toner cartridge 100 to imaging unit 200 may also be used to estimate the amount of toner remaining in reservoir 104. In this embodiment, the estimate of the amount of toner 105 remaining is decreased based on the amount of rotation of shaft 132 over the life of toner cartridge 100. The number of printable elements (pels) printed using the color of toner contained in toner cartridge 100 while toner cartridge 100 is installed in image forming device 22 may also be used to estimate the amount of toner remaining in reservoir 104.

The amount of rotation of shaft 132 that occurs between magnetic sensor 220 detecting first magnet 162 and magnetic sensor 220 detecting second magnet 182 may be used in combination with one or more of these operating conditions to estimate the amount of toner remaining in reservoir 104. For example, an estimate of the amount of toner remaining in reservoir 104 derived from the amount of rotation of shaft 132 that occurs between magnetic sensor 220 detecting first magnet 162 and magnetic sensor 220 detecting second magnet 182 may be weighted against toner level estimates derived from one or more operating conditions to produce an aggregate toner level estimate based on multiple factors. Alternatively, an estimate of the amount of toner remaining in reservoir 104 derived from the amount of rotation of shaft 132 that occurs between magnetic sensor 220 detecting first magnet 162 and magnetic sensor 220 detecting second magnet 182 may be used to periodically update a toner level estimate derived from one or more operating conditions in order to account for variability and to correct potential error in such an estimate. For example, an estimate of the toner level based on conditions such as an empirically derived feed rate of toner or the number of pels printed may drift from the actual amount of toner 105 remaining in reservoir 104 over the life of toner cartridge 100, i.e., a difference between an estimate of the toner level and the actual toner level may tend to increase over the life of toner cartridge 100. Recalculating the estimate of the amount of toner 105 remaining based on the motion of second magnet 182 relative to the motion of first magnet 162 helps correct this drift to provide a more accurate estimate of the amount of toner 105 remaining in reservoir 104.

Accordingly, an amount of toner remaining in reservoir 104 may be determined by sensing the relative motion between a fixed member, such as fixed arm 164, and a sensing member, such as sense arm 180, mounted on rotatable shaft 132 and rotatable independent of shaft 132 within a predetermined angular range of motion relative to shaft 132. Because the motion of the sensing linkage and the fixed linkage are detectable by a sensor outside of reservoir 104, the sensing linkage and the fixed linkage may be provided without an electrical or mechanical connection to the outside of housing 102 (other than shaft 132). This avoids the need to seal an additional connection into reservoir 104, which could be susceptible to leakage. Positioning magnetic sensor 220 outside of reservoir 104 reduces the risk of toner contamination, which could damage the sensor. Magnetic sensor 220 may also be used to detect the installation of toner cartridge 100 in image forming device 22 and to confirm that shaft 132 is rotating properly thereby eliminating the need for additional sensors to perform these functions.

Figure 10:
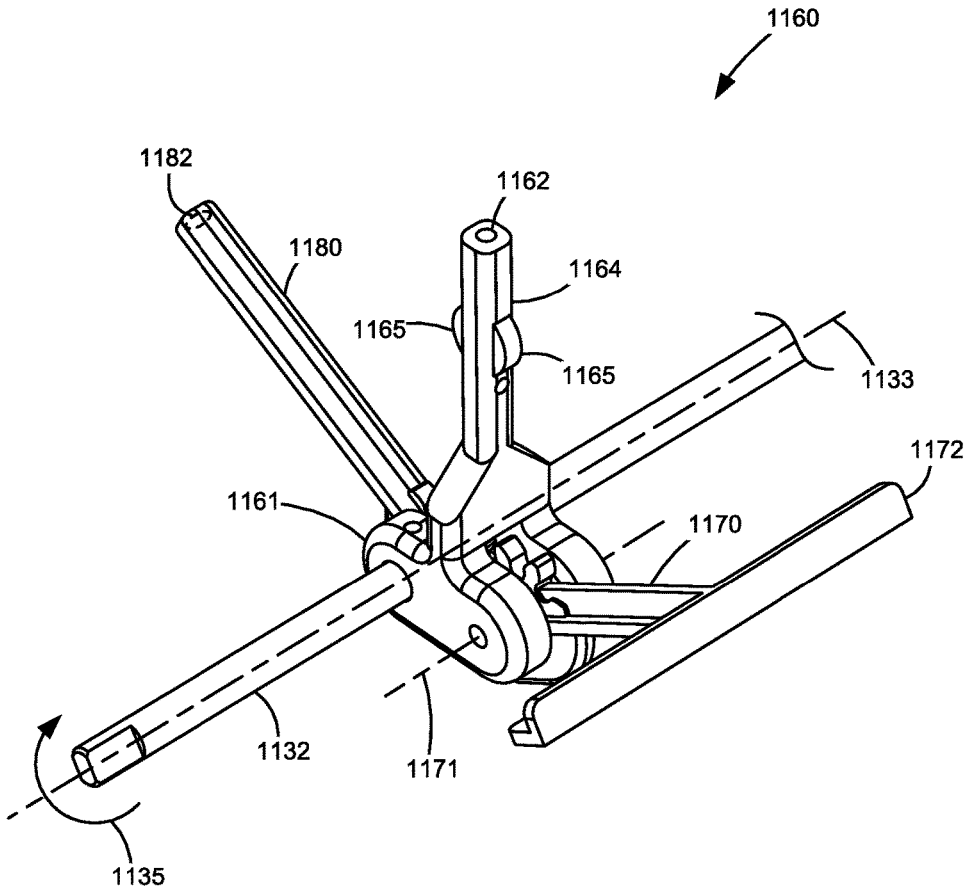
FIG. 10 is a perspective view of a toner level sensing assembly according to another example embodiment.

Those skilled in the art will appreciate that toner level sensing assembly 160 may take many different configurations and is not limited to the example embodiment in FIGS. 5A and 5B. For example, FIG. 10 shows a toner level sensing assembly 1160 according to another example embodiment. In this embodiment, toner level sensing assembly 1160 includes a fixed member 1161 that is fixed to a shaft 1132 such that fixed member 1161 rotates with shaft 1132. Fixed member 1161 includes a fixed arm 1164 having a first permanent magnet 1162 mounted at a radially outermost portion of fixed arm 1164 such that first magnet 1162 is positioned in close proximity to but does not contact the inner surfaces of the housing of the toner cartridge as discussed above. A paddle arm 1170 having a leading paddle member 1172 is connected to shaft 1132 and leads fixed arm 1164 and first magnet 1162 in an operative rotational direction 1135 of shaft 1132. Paddle arm 1170 is rotatable around an axis of rotation 1133 of shaft 1132 independent of shaft 1132 within a predetermined angular range of motion relative to shaft 1132. Specifically, in the embodiment illustrated, paddle arm 1170 is free to pivot about a pivot axis 1171 that is offset from axis of rotation 1133 of shaft 1132 and that is pivotable independent of shaft 1132 within a predetermined angular range of motion. A sense arm 1180 is also connected to shaft 1132 and trails fixed arm 1164 and first magnet 1162 in operative rotational direction 1135 of shaft 1132. Sense arm 1180 is rotatable around axis of rotation 1133 of shaft 1132 independent of shaft 1132 within a predetermined angular range of motion relative to shaft 1132. Sense arm 1180 includes a second permanent magnet 1182 positioned at a radially outermost portion of sense arm 1180 which extends in close proximity to but does not contact the inner surfaces of the housing of the toner cartridge as discussed above.

In the embodiment illustrated, fixed arm 1164 includes a pair of protrusions 1165 that limit the rotational motion of paddle arm 1170 and sense arm 1180 toward fixed arm 1164 thereby defining the minimum separation between fixed arm 1164 and each of paddle arm 1170 and sense arm 1180. In one embodiment, each protrusion 1165 is sized to provide sufficient spacing between first magnet 1162 and second magnet 1182 in order to permit separate detection of first magnet 1162 and second magnet 1182 by the magnetic sensor. Protrusions 1165 also aid gravity to allow paddle arm 1170 and sense arm 1180 to separate from fixed arm 1164 as fixed arm 1164 rotates past the uppermost point of its rotational path, such as when there is no toner resistance against paddle arm 1170.

Figure 11A:
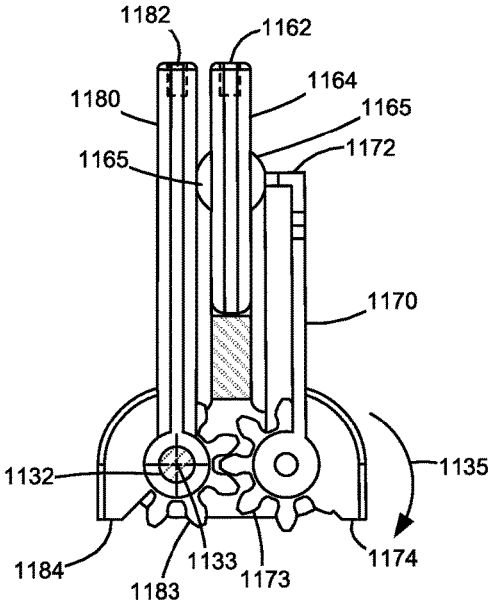
FIGS. 11A-11C are cross-sectional side views of the toner level sensing assembly in FIG. 10 at various positions according to one example embodiment.
Figure 11B:
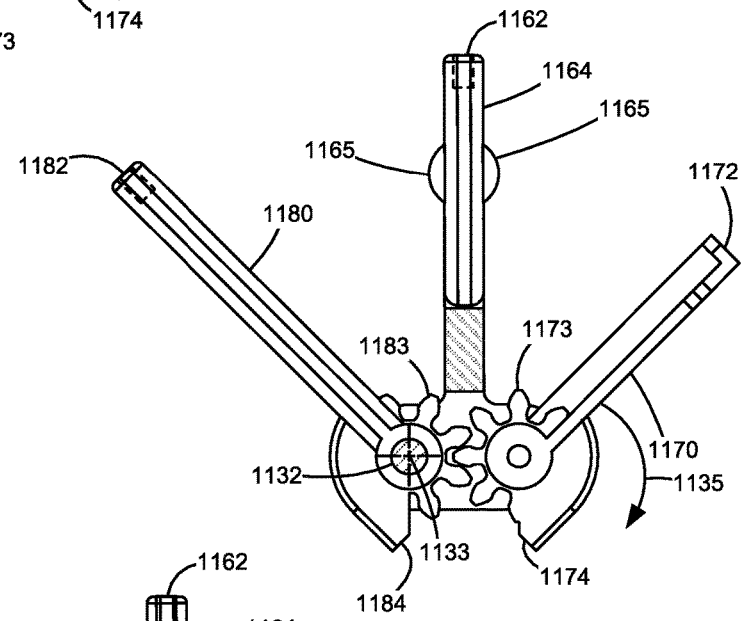
Figure 11C:
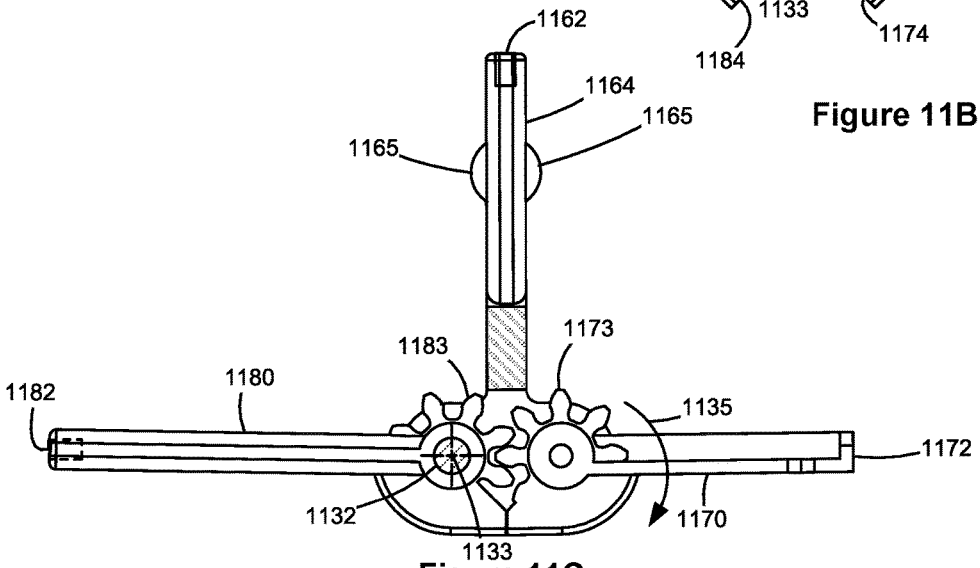

With reference to FIGS. 11A-1C, paddle arm 1170 and sense arm 1180 are operatively connected to each other by a gear arrangement in the example embodiment illustrated. Specifically, paddle arm 1170 includes a first sector gear 1173 positioned about pivot axis 1171 and sense arm 1180 includes a second sector gear 1183 positioned about axis of rotation 1133 of shaft 1132. First and second sector gears 1173, 1183 mesh with each other such that paddle arm 1170 and sense arm 1180 are movable together between a closed position (as shown in FIG. 11A) and an open position (as shown in FIG. 11C) relative to fixed arm 1164. In the closed position, paddle arm 1170 and sense arm 1180 contact protrusions 1165 on fixed arm 1164 and are substantially parallel to each other and to fixed arm 1164 in the embodiment shown. In the open position, paddle arm 1170 and sense arm 1180 are substantially 180° from each other in the embodiment shown. Each of first and second sector gears 1173, 1183 includes a corresponding rotational stop 1174, 1184 which prevents rotation of paddle arm 1170 and sense arm 1180 beyond 180° in the example embodiment illustrated. It will be appreciated, however, that rotational stops 1174, 1184 may take other forms or shapes and allow any maximum angle between paddle arm 1170 and sense arm 1180 as desired. In one embodiment, first and second sector gears 1173, 1183 are meshed such that the amount of angular offset between fixed arm 1164 and paddle arm 1170 is equal to the amount of angular offset between fixed arm 1164 and sense arm 1180. For example, in FIG. 11A, each of paddle arm 1170 and sense arm 1180 is in a 0° position relative to fixed arm 1164. In FIG. 11B, each of paddle arm 1170 and sense arm 1180 is in a 45° position relative to fixed arm 164. In FIG. 11C, each of paddle arm 1170 and sense arm 1180 is in a 90° position relative to fixed arm 1164.

Toner level sensing assembly 1160 operates in a similar manner to toner level sensing assembly 160 discussed above. In particular, the motion of sense arm 1180 and second magnet 1182 relative to first magnet 1162 on fixed arm 1164 as shaft 1132 rotates may be used to determine the amount of toner remaining in the reservoir of the toner cartridge. As shaft 1132 rotates, in the embodiment illustrated, fixed arm 1164 rotates with shaft 1132 causing first magnet 1162 to pass a magnetic sensor at the same point during each revolution of shaft 1132. On the other hand, the motion of sense arm 1180, which is free to rotate relative to shaft 1132 between forward and rearward rotational stops, depends on the amount of toner present in the reservoir. As a result, second magnet 1182 passes the magnetic sensor at different points during the revolution of shaft 1132 depending on the toner level in the reservoir as discussed above. Accordingly, variation in the angular separation or offset between first magnet 1162, which serves as a reference point, and second magnet 1182, which provides a sense point, as they pass the magnetic sensor may be used to determine the amount of toner remaining in the toner reservoir. The amount of rotation of shaft 1132 between the magnetic sensor detecting first magnet 1162 and the magnetic sensor detecting second magnet 1182 increases as the toner level in the reservoir decreases as discussed above. As a result, the motion of second magnet 182 relative to the motion of first magnet 162 relates to the amount of toner 105 remaining in reservoir 104.

Although the example embodiments discussed above utilize a variable angular offset between a pair of magnets to determine an amount of toner in the reservoir of a toner cartridge, it will be appreciated that the variable angular offset between a pair of magnets may be used to determine an amount of toner in any reservoir or sump storing toner in image forming device 22 such as, for example, a reservoir of the imaging unit or a storage area for waste toner. Further, although the example embodiments discussed above discuss a system for determining a toner level, it will be appreciated that this system and the methods discussed herein may be used to determine the level of a particulate material other than toner such as, for example, grain, seed, flour, sugar, salt, etc.

Although the example embodiment discussed above includes a pair of replaceable units in the form of toner cartridge 100 and imaging unit 200, it will be appreciated that the replaceable unit(s) of the image forming device may employ any suitable configuration as desired. For example, in one embodiment, the main toner supply for the image forming device, the developer unit and the cleaner unit are housed in one replaceable unit. In another embodiment, the main toner supply for the image forming device and the developer unit are provided in a first replaceable unit and the cleaner unit is provided in a second replaceable unit. Further, although the example image forming device 22 discussed above includes one toner cartridge and corresponding imaging unit, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

Further, it will be appreciated that the architecture and shape of toner cartridge 100 illustrated in FIGS. 2-4 is merely intended to serve as an example. Those skilled in the art understand that toner cartridges, and other toner reservoirs, may take many different shapes and configurations. Similarly, skilled artisans also appreciate that shaft 132, paddle assembly 140 and toner level sensing assembly 160 may take many different shapes and configurations depending on the toner reservoir they are employed in.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container, comprising:

a housing having a reservoir for storing toner;

a rotatable shaft positioned within the reservoir and having an axis of rotation;

a first magnet rotatable with the rotatable shaft around the axis of rotation;

an arm connected to the shaft and leading the first magnet around the axis of rotation in an operative rotational direction of the rotatable shaft; and a second magnet connected to the shaft and trailing the first magnet around the axis of rotation in the operative rotational direction of the rotatable shaft;

wherein the arm and the second magnet are each rotatable independent of the rotatable shaft between a respective forward rotational stop and a respective rearward rotational stop such that an angular offset between the first magnet and the arm and an angular offset between the first magnet and the second magnet vary depending on a rotational position of the arm and a rotational position of the second magnet relative to the respective forward rotational stop and the respective rearward rotational stop, the arm is operatively connected to the second magnet such that an amount of the angular offset between the first magnet and the second magnet increases as an amount of the angular offset between the first magnet and the arm increases and the amount of the angular offset between the first magnet and the second magnet decreases as the amount of the angular offset between the first magnet and the arm decreases.

2. The toner container of claim 1, wherein the second magnet is substantially axially aligned with the first magnet with respect to the axis of rotation.

3. The toner container of claim 1, wherein the second magnet is substantially radially aligned with the first magnet with respect to the axis of rotation.

4. The toner container of claim 1, wherein the first magnet is fixed to rotate with the rotatable shaft.

5. The toner container of claim 1, wherein the first magnet and the second magnet pass near a point on an inner wall of the housing forming the reservoir once per revolution of the rotatable shaft for detection by a magnetic sensor when the toner container is installed in an image forming device for determining an amount of toner present in the reservoir based on the amount of angular offset between the first magnet and the second magnet.

6. The toner container of claim 1, wherein the arm is operatively connected to the second magnet such that the amount of angular offset between the first magnet and the second magnet is equal to the amount of angular offset between the first magnet and the arm.

7. The toner container of claim 1, further comprising a gear assembly operatively connecting the arm to the second magnet such that rotation of the arm relative to the rotatable shaft toward and away from the first magnet causes the second magnet to rotate relative to the rotatable shaft toward and away from the first magnet, respectively.

8. The toner container of claim 1, further comprising a linkage slidable along an extension from the rotatable shaft, the first magnet is positioned on the extension, the arm and the second magnet are operatively connected to the linkage such that movement of the linkage along the extension toward and away from the rotatable shaft causes the arm and the second magnet to pivot relative to the rotatable shaft away from and toward the first magnet, respectively.

9. A toner container, comprising:

a housing having a reservoir for storing toner;

a rotatable shaft positioned within the reservoir and having an axis of rotation;

a first magnet rotatable with the rotatable shaft around the axis of rotation;

an arm connected to the shaft and rotatable around the axis of rotation independent of the rotatable shaft within a predetermined angular range of motion relative to the rotatable shaft, the arm leading the first magnet in an operative rotational direction of the rotatable shaft; and a second magnet connected to the shaft and rotatable around the axis of rotation independent of the rotatable shaft within a predetermined angular range of motion relative to the rotatable shaft, the second magnet trailing the first magnet in the operative rotational direction of the rotatable shaft;

wherein the arm and the second magnet are operatively connected such that an amount of angular offset between the first magnet and the second magnet increases as an amount of angular offset between the first magnet and the arm increases and the amount of angular offset between the first magnet and the second magnet decreases as the amount of angular offset between the first magnet and the arm decreases.

10. The toner container of claim 9, wherein the second magnet is substantially axially aligned with the first magnet with respect to the axis of rotation.

11. The toner container of claim 9, wherein the second magnet is substantially radially aligned with the first magnet with respect to the axis of rotation.

12. The toner container of claim 9, wherein the first magnet is fixed to rotate with the rotatable shaft.

13. The toner container of claim 9, wherein the first magnet and the second magnet pass near a point on an inner wall of the housing forming the reservoir once per revolution of the rotatable shaft for detection by a magnetic sensor when the toner container is installed in an image forming device for determining an amount of toner present in the reservoir based on the amount of angular offset between the first magnet and the second magnet.

14. The toner container of claim 9, wherein the arm is operatively connected to the second magnet such that the amount of angular offset between the first magnet and the second magnet is equal to the amount of angular offset between the first magnet and the arm.

15. The toner container of claim 9, further comprising a gear assembly operatively connecting the arm to the second magnet such that rotation of the arm relative to the rotatable shaft toward and away from the first magnet causes the second magnet to rotate relative to the rotatable shaft toward and away from the first magnet, respectively.

16. The toner container of claim 9, further comprising a linkage slidable along an extension from the rotatable shaft, the first magnet is positioned on the extension, the arm and the second magnet are operatively connected to the linkage such that movement of the linkage along the extension toward and away from the rotatable shaft causes the arm and the second magnet to pivot relative to the rotatable shaft away from and toward the first magnet, respectively.

17. A toner container, comprising:

a housing having a reservoir for storing toner;

a rotatable shaft positioned within the reservoir and having an axis of rotation;

a first magnet connected to the shaft and fixed to rotate around the axis of rotation with the shaft;

a paddle connected to the shaft and leading the first magnet around the axis of rotation in an operative rotational direction of the rotatable shaft, the paddle is rotatable independent of the rotatable shaft between a first forward rotational stop and a first rearward rotational stop;

a second magnet connected to the shaft and trailing the first magnet around the axis of rotation in the operative rotational direction of the shaft, the second magnet is rotatable independent of the rotatable shaft between a second forward rotational stop and a second rearward rotational stop; and a linkage connecting the paddle and the second magnet such that an amount of angular offset between the first magnet and the paddle increases as an amount of angular offset between the first magnet and the second magnet increases and the amount of angular offset between the first magnet and the paddle decreases as the amount of angular offset between the first magnet and the second magnet decreases, wherein the first magnet and the second magnet pass near a point on an inner wall of the housing forming the reservoir once per revolution of the rotatable shaft for detection by a magnetic sensor when the toner container is installed in an image forming device for determining an amount of toner present in the reservoir based on the amount of angular offset between the first magnet and the second magnet.

18. The toner container of claim 17, wherein the paddle is operatively connected to the second magnet such that the amount of angular offset between the first magnet and the second magnet is equal to the amount of angular offset between the first magnet and the paddle.

19. The toner container of claim 17, further comprising a gear assembly operatively connecting the paddle to the second magnet such that rotation of the paddle relative to the rotatable shaft toward and away from the first magnet causes the second magnet to rotate relative to the rotatable shaft toward and away from the first magnet, respectively.

20. The toner container of claim 17, further comprising a linkage slidable along an extension from the rotatable shaft, the first magnet is positioned on the extension, the paddle and the second magnet are operatively connected to the linkage such that movement of the linkage along the extension toward and away from the rotatable shaft causes the paddle and the second magnet to pivot relative to the rotatable shaft away from and toward the first magnet, respectively.

* * * * *